US012018665B2

(12) United States Patent
Devanawar et al.

(10) Patent No.: US 12,018,665 B2
(45) Date of Patent: Jun. 25, 2024

(54) SINGLE PIECE VALVE PLATE ASSEMBLY FOR A RECIPROCATING COMPRESSOR, THE VALVE PLATE ASSEMBLY INCLUDING A VALVE PLATE AND A SUCTION VALVE RETAINER THAT ARE INTEGRALLY FORMED AS A UNITARY BODY

(71) Applicant: Copeland LP, Sidney, OH (US)

(72) Inventors: Siddharth Dhanpal Devanawar, Pune (IN); Janardhan Sakhahari Kolpe, Pune (IN); Rajesh Vasant More, Pune (IN)

(73) Assignee: Copeland LP, Sidney, OH (US)

( * ) Notice: Subject to any disclaimer, the term of this patent is extended or adjusted under 35 U.S.C. 154(b) by 72 days.

(21) Appl. No.: 17/461,256

(22) Filed: Aug. 30, 2021

(65) Prior Publication Data

US 2021/0388828 A1 Dec. 16, 2021

Related U.S. Application Data

(62) Division of application No. 15/583,491, filed on May 1, 2017, now Pat. No. 11,105,326.

(30) Foreign Application Priority Data

May 7, 2016 (IN) ..... 201621016024
Oct. 11, 2016 (IN) ..... 201624034755

(51) Int. Cl.
*F04B 39/10* (2006.01)
*F04B 27/00* (2006.01)
(Continued)

(52) U.S. Cl.
CPC ..... *F04B 39/1066* (2013.01); *F04B 27/00* (2013.01); *F04B 27/0451* (2013.01);
(Continued)

(58) Field of Classification Search
CPC ..... F04B 53/007; F04B 53/16
See application file for complete search history.

(56) References Cited

U.S. PATENT DOCUMENTS 737,809 A 9/1903 Whitaker
758,183 A 4/1904 Kryszat
(Continued)

FOREIGN PATENT DOCUMENTS

EP 1041283 A2 10/2000
WO WO-2013182409 A1 12/2013
WO WO-2016052318 A1 4/2016

OTHER PUBLICATIONS

U.S. Appl. No. 15/583,424, filed May 1, 2017, Kolpe.
U.S. Appl. No. 15/583,491, filed May 1, 2017, Devanawar et al..

*Primary Examiner* — Connor J Tremarche
*Assistant Examiner* — Geoffrey S Lee
(74) *Attorney, Agent, or Firm* — Harness, Dickey & Pierce, P.L.C.

(57) ABSTRACT

A valve plate assembly for a compressor according to the principles of the present disclosure includes a valve plate and a suction valve retainer. The valve plate is configured to separate suction-pressure working fluid entering a cylinder of the compressor from discharge-pressure working fluid exiting the cylinder of the compressor. The valve plate defines a discharge valve seat. The suction valve retainer is configured to retain a suction valve within a suction valve seat disposed about a central longitudinal axis of the cylinder.

19 Claims, 15 Drawing Sheets

(51) Int. Cl.
*F04B 27/04* (2006.01)
*F04B 39/12* (2006.01)
*F04B 39/14* (2006.01)

(52) U.S. Cl.
CPC ..... *F04B 39/1086* (2013.01); *F04B 39/125* (2013.01); *F04B 39/14* (2013.01)

(56) References Cited

U.S. PATENT DOCUMENTS 947,536 A * 1/1910 Wenkel ..... A47K 5/1204 417/558
1,425,663 A * 8/1922 Lawhead ..... F04B 39/1033 417/567
1,476,794 A * 12/1923 Berry ..... F04B 39/1086 417/571
1,652,978 A * 12/1927 Enock ..... F04B 39/1006 137/512.1
1,719,572 A 7/1929 Stoll
1,739,603 A 12/1929 McCune
1,820,732 A 8/1931 Davey
2,000,735 A 5/1935 Arnold
2,011,563 A 8/1935 Balfe
2,062,206 A * 11/1936 Browne ..... F16K 15/16 417/571
2,431,733 A 12/1947 Crittenden
2,510,887 A * 6/1950 Hanson ..... F04B 39/064 62/505
2,522,962 A 9/1950 Reger
2,565,564 A 8/1951 Lamberton
2,579,667 A * 12/1951 Hanson ..... F04B 39/1033 137/512.2
2,728,351 A * 12/1955 Cooper ..... F04B 39/1086 137/516.15
2,815,901 A 12/1957 Hale
3,540,470 A * 11/1970 Grant ..... F04B 39/1033 137/516.17
3,865,345 A * 2/1975 Kropiwnicki ..... F04B 39/10 251/367
3,971,407 A * 7/1976 Hudson ..... F04B 39/1086 137/516.17
4,059,367 A 11/1977 Marshall
4,100,934 A * 7/1978 Butterworth ..... F04B 39/1073 417/571
4,115,044 A * 9/1978 Gannaway ..... F04B 39/1033 417/564
4,329,125 A 5/1982 Chambers
4,368,755 A 1/1983 King
4,385,872 A 5/1983 Anderson
4,445,534 A * 5/1984 King ..... F04B 39/10 137/543.17
4,478,243 A 10/1984 King
4,685,489 A * 8/1987 Yun ..... F04B 39/1033 417/440
4,699,572 A 10/1987 Balkau et al.
4,701,114 A * 10/1987 Andersen ..... F04B 39/1086 417/373
5,170,752 A 12/1992 Binversie et al.
5,203,857 A 4/1993 Terwilliger et al.
5,213,487 A * 5/1993 Ritchie ..... F04B 39/1033 417/567
5,427,506 A 6/1995 Fry et al.
5,678,983 A 10/1997 Lilie
6,896,495 B2 5/2005 Majerus et al.
7,040,877 B2 5/2006 Bergman et al.
7,074,022 B2 7/2006 Majerus et al.
7,214,040 B2 * 5/2007 Froeslev ..... F04B 39/1073 417/571
8,197,240 B2 * 6/2012 Obara ..... F04B 39/1066 417/571
2005/0169785 A1 * 8/2005 Majerus ..... F04B 39/1066 417/521
2006/0034707 A1 2/2006 Thomas et al.
2008/0063551 A1 3/2008 Cornwell
2008/0237510 A1 10/2008 Chou
2008/0310980 A1 12/2008 Ramsdorf et al.
2011/0158825 A1 6/2011 Speir
2014/0003986 A1 * 1/2014 Elson ..... F04B 39/108 417/559
2014/0170006 A1 * 6/2014 Bergman ..... F04B 53/14 417/559
2017/0321678 A1 11/2017 Kolpe

* cited by examiner

SINGLE PIECE VALVE PLATE ASSEMBLY FOR A RECIPROCATING COMPRESSOR, THE VALVE PLATE ASSEMBLY INCLUDING A VALVE PLATE AND A SUCTION VALVE RETAINER THAT ARE INTEGRALLY FORMED AS A UNITARY BODY

CROSS-REFERENCE TO RELATED APPLICATIONS

This application is a divisional of U.S. patent application Ser. No. 15/583,491, filed on May 1, 2017, which claims the benefit of Indian Patent Application No. 201624034755, filed on Oct. 11, 2016, which claims the benefit of Indian Patent Application No. 201621016024, filed on May 7, 2016. The entire disclosures of the applications referenced above are incorporated herein by reference.

FIELD

The present disclosure relates to a single valve plate assembly for a reciprocating compressor.

BACKGROUND

This section provides background information related to the present disclosure which is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure provides a valve plate assembly for a compressor. The valve plate assembly includes a valve plate and a suction valve retainer. The valve plate is configured to separate suction-pressure working fluid entering a cylinder of the compressor from discharge-pressure working fluid exiting the cylinder of the compressor. The valve plate defines a discharge valve seat. The suction valve retainer is configured to retain a suction valve within a suction valve seat disposed about a central longitudinal axis of the cylinder and to extend radially outward from the central longitudinal axis of the cylinder without extending beyond a suction passage of the compressor.

In some configurations, the compressor defines multiple suction passages and the entire suction valve retainer is configured to be located further away from an outer perimeter of the compressor than the suction passages.

In some configurations, the valve plate is configured to be attached to the compressor using fasteners, and the fasteners do not extend through the suction valve retainer when the valve plate assembly is assembled to the compressor.

In some configurations, the suction valve retainer is configured to engage an outer perimeter of the suction valve to limit movement of the suction valve when discharge-pressure working fluid is expelled from the cylinder of the compressor.

In some configurations, the compressor includes multiple cylinders and the suction valve retainer includes an annular disk portion configured to be disposed about the central longitudinal axis of each of the cylinders.

In some configurations, the valve plate includes a flat portion and hollow conical frustum portions projecting from the flat portion and configured to extend toward the cylinders when the valve plate is mounted to the compressor, each of the hollow conical frustum portions defining the discharge valve seat.

In some configurations, the valve plate and the suction valve retainer are separate from each other.

In some configurations, the valve plate and the suction valve retainer are integrally formed as a unitary body.

In some configurations, the valve plate is configured to be mounted to a first mounting surface of the compressor, and the suction valve retainer is configured to be mounted to a second mounting surface of the compressor that is different than the first mounting surface.

In some configurations, the valve plate is configured to be mounted to a mounting surface of the compressor, and the suction valve retainer is configured to be mounted to the same mounting surface of the compressor.

In another form, the present disclosure provides another valve plate assembly for a compressor. The valve plate assembly includes a valve plate and a suction valve retainer. The valve plate is configured to be mounted to a first mounting surface of the compressor and to separate suction-pressure working fluid entering a cylinder of the compressor from discharge-pressure working fluid exiting the cylinder of the compressor. The valve plate defines a discharge valve seat. The suction valve retainer is configured to be mounted to a second mounting surface of the compressor and to retain a suction valve within a suction valve seat disposed about a central longitudinal axis of the cylinder. The valve plate and the suction valve retainer are separate from each other.

In some configurations, the second mounting surface is different than the first mounting surface.

In some configurations, the second mounting surface is raised relative to the first mounting surface.

In some configurations, the compressor includes multiple cylinders and the suction valve retainer includes annular disk portions that are each configured to be disposed about the central longitudinal axis of one of the cylinders.

In some configurations, the suction valve retainer consists of the annular disk portions.

In some configurations, the valve plate includes a flat portion and hollow conical frustum portions projecting from the flat portion and configured to extend toward the cylinders when the valve plate is mounted to the compressor, each of the hollow conical frustum portions defining the discharge valve seat.

In some configurations, the flat portion of the valve plate defines holes disposed about an outer perimeter of the flat portion for receiving fasteners to attach the valve plate to the compressor.

In some configurations, the valve plate further includes collars disposed about the holes and projecting from the flat portion of the valve plate, the collars being configured to locate the valve plate relative to the compressor in a plane parallel to the first mounting surface of the compressor.

In another form, the present disclosure provides yet another valve plate assembly for a compressor. The valve plate assembly includes a valve plate and a suction valve retainer. The valve plate is configured to be mounted to a mounting surface of the compressor and to separate suction-pressure working fluid entering a cylinder of the compressor from discharge-pressure working fluid exiting the cylinder of the compressor. The valve plate defines a discharge valve seat. The suction valve retainer is configured to be mounted to the mounting surface of the compressor and to engage an outer perimeter of a suction valve to retain the suction valve within a suction valve seat disposed about a central longitudinal axis of the cylinder. The valve plate and the suction valve retainer are integrally formed as a unitary body.

In some configurations, the valve plate assembly further includes posts disposed between the valve plate and the suction valve retainer and configured to hold the suction valve retainer in place when discharge-pressure working fluid is expelled from the cylinder of the compressor. The valve plate, the suction valve retainer, and the posts are integrally formed as a unitary body.

In some configurations, the valve plate assembly further includes an annular projection disposed about an outer perimeter of the valve plate and configured to project from the valve plate toward the mounting surface of the compressor. The valve plate, the suction valve retainer, the posts, and the annular projection are integrally formed as a unitary body.

In some configurations, the annular projection projects from the valve plate by an amount that is greater than or equal to a sum of a thickness of the suction valve retainer and a height of the posts.

In some configurations, the compressor includes multiple cylinders and the suction valve retainer includes annular disk portions that are each configured to be disposed about the central longitudinal axis of one of the cylinders.

In some configurations, the valve plate includes a flat portion and hollow conical frustum portions projecting from the flat portion and configured to extend toward the cylinders when the valve plate is mounted to the compressor, each of the hollow conical frustum portions defining the discharge valve seat.

In some configurations, a bottom surface of each of the annular disk portions of the suction valve retainer is configured to engage an outer perimeter of the suction valve to limit movement of the suction valve when discharge-pressure working fluid is expelled from the cylinder of the compressor.

In some configurations, a bottom surface of each of the hollow conical frustum portions of the valve plate is configured to engage an inner perimeter of the suction valve to limit movement of the suction valve when discharge-pressure working fluid is expelled from the cylinder of the compressor.

In some configurations, the bottom surfaces of the hollow conical frustum portions of the valve plate are configured to be flush with the bottom surfaces of the annular disk portions of the suction valve retainer when the valve plate assembly is assembled to the compressor.

In another form, the present disclosure provides a compressor assembly that includes a compressor housing, a valve plate, and a suction valve retainer. The compressor housing defines a cylinder, a suction valve seat disposed about a central longitudinal axis of the cylinder, a first mounting surface, and a second mounting surface that is different than the first mounting surface, and a valve plate configured to mount to the second mounting surface of the compressor housing and to separate suction-pressure working fluid entering a cylinder of the compressor from discharge-pressure working fluid exiting the cylinder of the compressor. The valve plate defines a discharge valve seat. The suction valve retainer is configured to mount to the first mounting surface of the compressor housing and to retain a suction valve within the suction valve seat of the compressor housing.

In some configurations, the suction valve seat is recessed relative to the first mounting surface.

In some configurations, the valve plate and the suction valve retainer are separate from each other.

In some configurations, the second mounting surface is different than the first mounting surface.

In some configurations, the second mounting surface is raised relative to the first mounting surface.

In some configurations, the compressor assembly further includes posts disposed between the valve plate and the suction valve retainer and configured to hold the suction valve retainer in place when discharge-pressure working fluid is expelled from the cylinder of the compressor.

In some configurations, an amount by which the second mounting surface is raised relative to the first mounting surface is greater than or equal to a sum of a thickness of the suction valve retainer and a height of the posts.

In another form, the present disclosure provides another compressor assembly that includes a compressor housing, a valve plate, and a suction valve retainer. The compressor housing defines a cylinder, a suction valve seat disposed about a central longitudinal axis of the cylinder, and a mounting surface. The valve plate is configured to mount to the mounting surface of the compressor housing and to separate suction-pressure working fluid entering a cylinder of the compressor from discharge-pressure working fluid exiting the cylinder of the compressor. The valve plate defines a discharge valve seat. The suction valve retainer is configured to mount to the mounting surface of the compressor housing and to retain a suction valve within the suction valve seat of the compressor housing. The valve plate and the suction valve retainer are integrally formed as a unitary body.

In some configurations, the suction valve seat is recessed relative to the mounting surface.

In some configurations, the compressor assembly further includes posts disposed between the valve plate and the suction valve retainer and configured to hold the suction valve retainer in place when discharge-pressure working fluid is expelled from the cylinder of the compressor. The valve plate, the suction valve retainer, and the posts are integrally formed as a unitary body.

In some configurations, the compressor includes multiple cylinders and the suction valve retainer consists of overlapping annular disk portions that are each configured to be disposed about the central longitudinal axis of one of the cylinders.

In some configurations, the valve plate includes a flat portion and hollow conical frustum portions projecting from the flat portion and configured to extend toward the cylinders when the valve plate is mounted to the compressor, each of the hollow conical frustum portions defining the discharge valve seat.

In some configurations, each of the hollow conical frustum portions of the valve plate is concentric with a corresponding one of the annular disk portions of the suction valve retainer.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
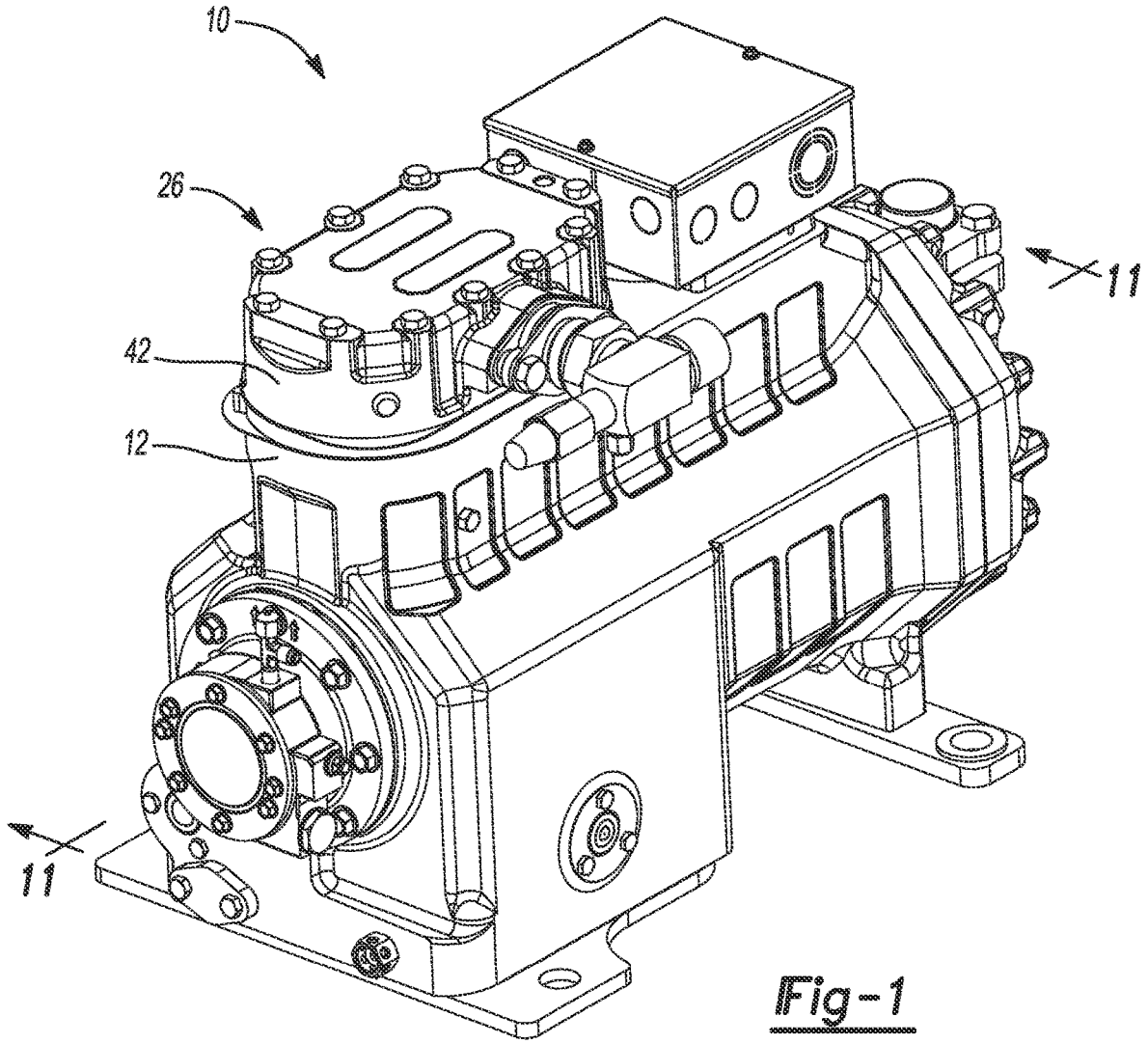
FIG. 1 is a perspective view of a compressor assembly according to the principles of the present disclosure.

Example embodiments will now be described more fully with reference to the accompanying drawings.

Reciprocating compressors typically include a shell or housing that defines one or more cylinders and a cylinder head assembly that cooperates with the cylinders to define compression chambers. The cylinder head assembly typically includes a cylinder head and a valve plate. The cylinder head covers the cylinders, supplies suction-pressure working fluid to the compression chambers, and receives discharge-pressure working fluid from the compression chambers. The valve plate separates the suction-pressure working fluid and the discharge-pressure working fluid from each other as the two pressure levels of working fluid flow between the interior of the cylinder head and the compression chambers. In this regard, the valve plate typically defines a suction port for the suction-pressure working fluid and a discharge port for the discharge-pressure working fluid.

In some conventional cylinder head assemblies, the valve plate is an assembly of three plates—a top plate, a middle plate, and a bottom plate. These three plates are manufactured individually by a stamping process, and then the top and bottom faces of the plates are precisely machined. The three plates are then stacked and brazed together with posts therebetween. An example of such a valve plate is disclosed in U.S. Pat. No. 7,040,877 (see, e.g., elements 18, 26, 28, 30, 32, and 34 of FIGS. 3 and 4 of the '877 patent). After brazing, the valve plate is heat treated and once again machined. These processes are time consuming and costly, and may require transporting the valve plate to multiple manufacturing facilities.

In addition, refrigerant flow is complex in three-plate valve plates such as the valve plate disclosed in the '877 patent. Refrigerant flows through suction passages in the compressor housing, through a hollow portion in the valve plate disposed between the top, bottom, and middle plates, and into the cylinders. The hollow portion in the valve plate, referred to as a suction chamber, includes a number of passages and ports which restrict the flow of the refrigerant and thereby decrease the efficiency of the compressor. In addition, the size of the suction chamber limits the flow rate of the refrigerant entering the cylinders.

The passages and ports in the suction chamber, as well as the size of the suction chamber, are affected by the presence and geometry of the middle and bottom plates. For example, all three plates typically extend to the outer perimeter of a mounting surface of the compressor housing so that fasteners may be inserted through all three plates and into a perimeter of the mounting surface to attach the cylinder head assembly to the compressor housing. The portions of the three plates that extend to the outer perimeter of a mounting surface encroach upon space that may otherwise be part of the suction chamber, and thereby limit the size of the suction chamber.

In contrast, a cylinder head assembly according to the present disclosure includes a valve plate that is formed as a single piece (or unitary body). In one embodiment, the valve plate primarily consists of the top plate, while portions of the middle and bottom plates are eliminated, integrated into the compressor housing, and/or integrated into a stand-alone component referred to herein as a suction valve retainer. In another embodiment, instead of integrating portions of the middle and bottom plates into the compressor housing, those portions are integrated into the single piece valve plate. In either embodiment, the portion of the bottom plate that extends to the outer perimeter of the mounting surface on the compressor housing is eliminated.

Forming the valve plate as a single piece instead of multiple pieces reduces the cost, time, and effort associated with manufacturing and assembling the cylinder head assembly, and enables the overall size of the cylinder head assembly to be reduced. In addition, by eliminating portions of the middle and bottom plates, the size of the suction chamber may be increased, which reduces the amount of flow restriction placed on the refrigerant and thereby increases the efficiency of the compressor. Further, since the portion of the bottom plate that extends to the outer perimeter of the mounting surface is eliminated, the suction chamber is mostly open to the mounting surface. Thus, the size and number of the suction passages extending through the mounting surface may be increased, which further reduces flow restriction and increases compressor efficiency.

Figure 11:
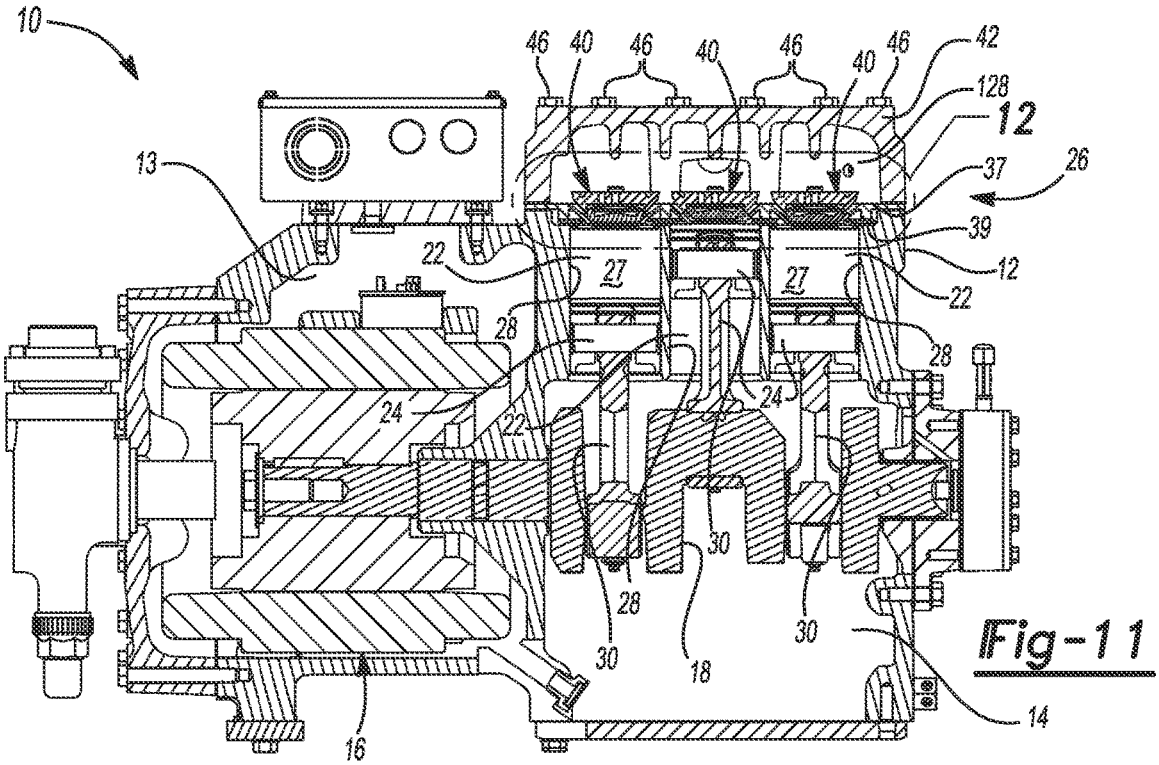
FIG. 11 is a cross-sectional view of the compressor assembly of FIG. 1 taken along a line 11-11 shown in FIG. 1.

Referring now to FIGS. 1 and 11, a compressor 10 (e.g., a reciprocating compressor) includes a shell or housing 12 defining a suction plenum 13 and an interior volume 14 in which a motor 16 and a crankshaft 18 are disposed. The housing 12 includes one or more cylinders 22 (i.e., cylindrical bores). Each of the cylinders 22 slidably receives a piston 24. Each cylinder 22 and corresponding piston 24 cooperate with a cylinder head assembly 26 to define a compression chamber 27. Each piston 24 may include piston rings that sealingly and slidably contact an inner diametrical surface 28 of a corresponding one of the cylinders 22. Each piston 24 is drivingly connected to the crankshaft 18 by a connecting rod 30 so that rotation of the crankshaft 18 (driven by the motor) causes the piston 24 to reciprocate within the corresponding cylinder 22.

Figure 4:
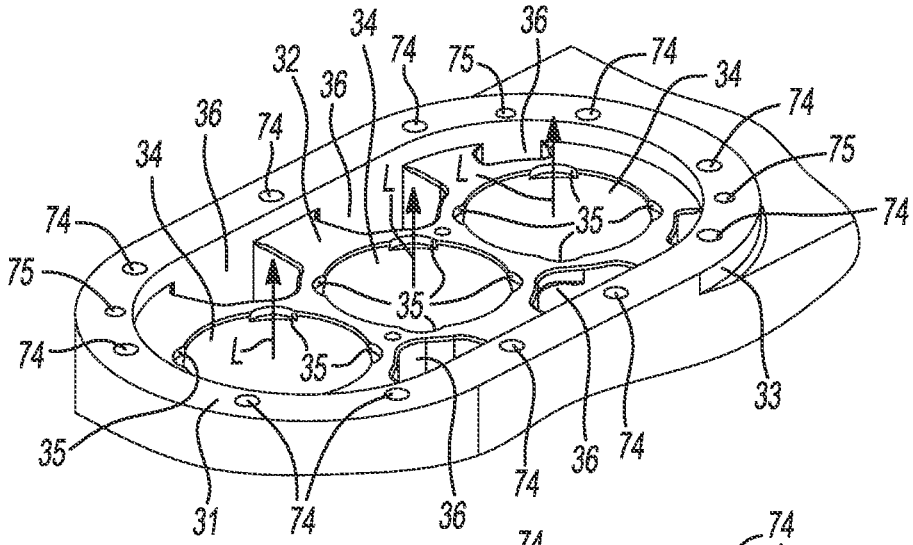
FIG. 4 is a perspective view of a shell or housing of the compressor assembly of FIG. 1.
Figure 5:
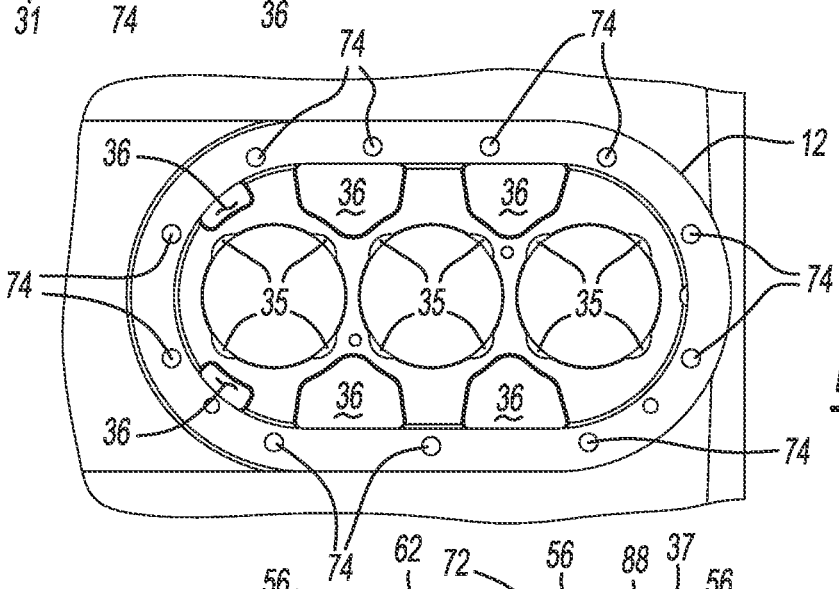
FIG. 5 is a top of the housing of the compressor assembly of FIG. 1.

As shown in FIGS. 4 and 5, the housing 12 includes a first mounting surface 31 and a second mounting surface 32. The first mounting surface 31 is raised or elevated relative to the second mounting surface 32. In this regard, the housing 12 includes an oval annular projection 33 that projects from the second mounting surface 32, and the first mounting surface 31 forms the top surface of the annular projection 33.

The cylinders 22 extend through the second mounting surface 32 such that the second mounting surface 32 defines openings 34 of the cylinders 22. The second mounting surface 32 also defines a plurality of pockets or recesses 35 that are open to the cylinders 22. The recesses 35 extend radially outward (i.e., in a radial direction relative to longitudinal axes of the cylinders 22) from the inner diametrical surfaces 28 of the cylinders 22. The recesses 35 are recessed relative to the second mounting surface 32 in a direction parallel to the longitudinal axes of the cylinders 22. In the example shown in FIGS. 4 and 5, there are four of the recesses disposed every 90 degrees about the perimeter of each of the cylinders 22, and each group of four recesses cooperate to define a suction valve seat for the corresponding cylinder 22. Each suction valve seat is disposed about a central longitudinal axis L of the corresponding cylinder 22. Suction passages 36 in the housing 12 also extend through the second mounting surface 32 to provide suction-pressure working fluid from the suction plenum 13 (FIG. 11) to the cylinder head assembly 26 and, ultimately, to the cylinders 22.

Figure 2:
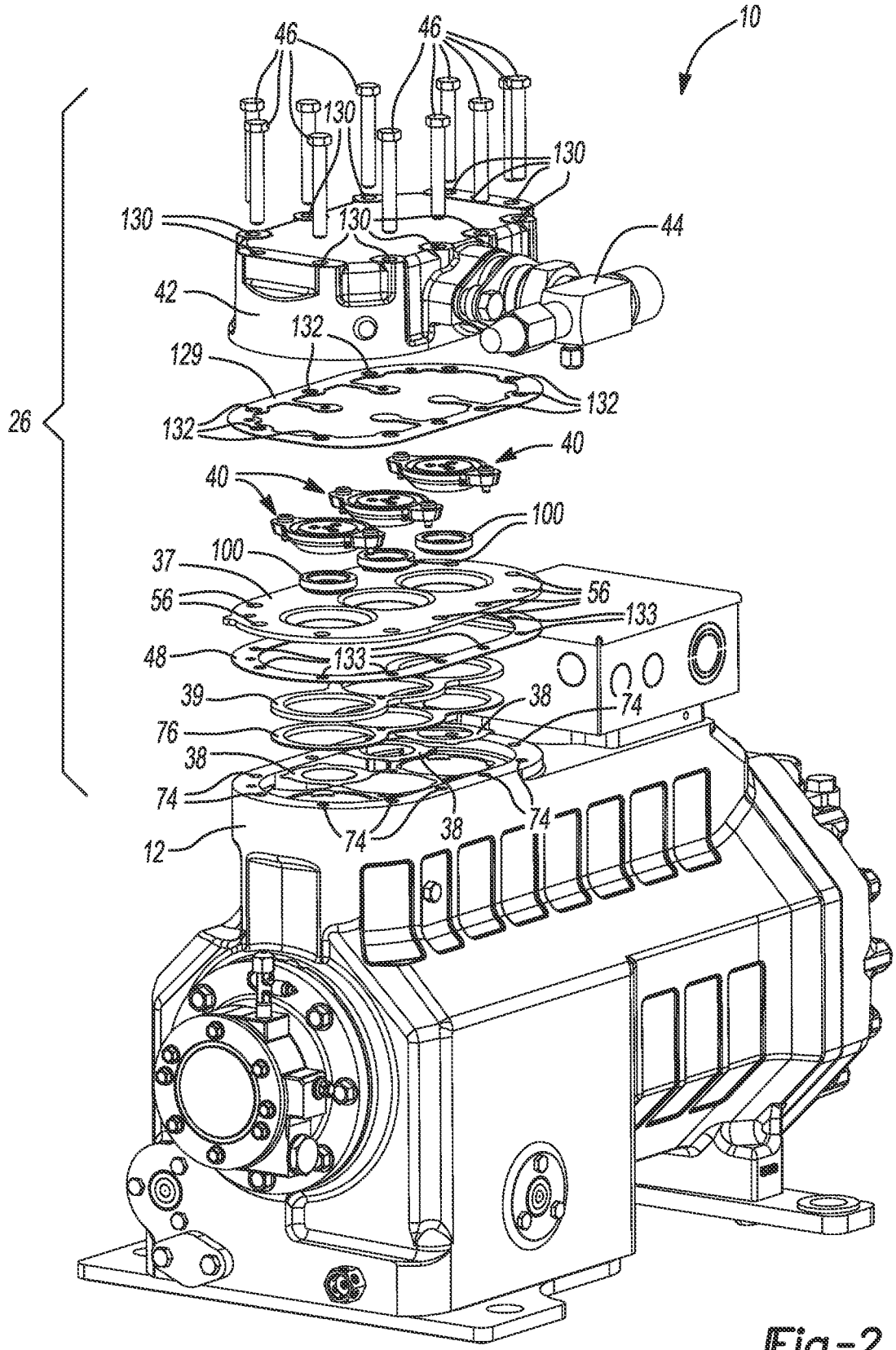
FIG. 2 is a partially exploded perspective view of the compressor assembly of FIG. 1.
Figure 3:
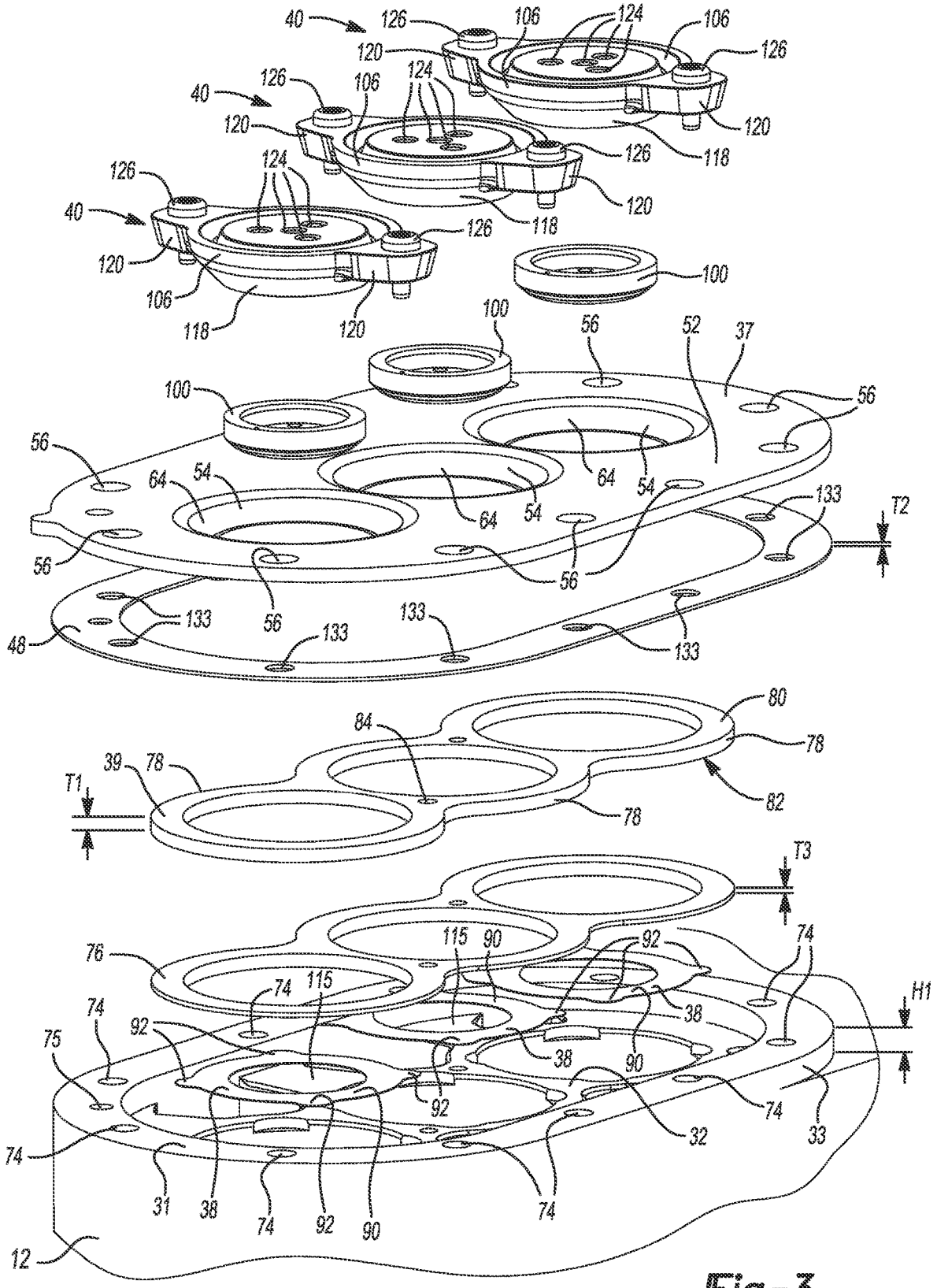
FIG. 3 is an exploded perspective view of a portion of the compressor assembly of FIG. 1.
Figure 12:
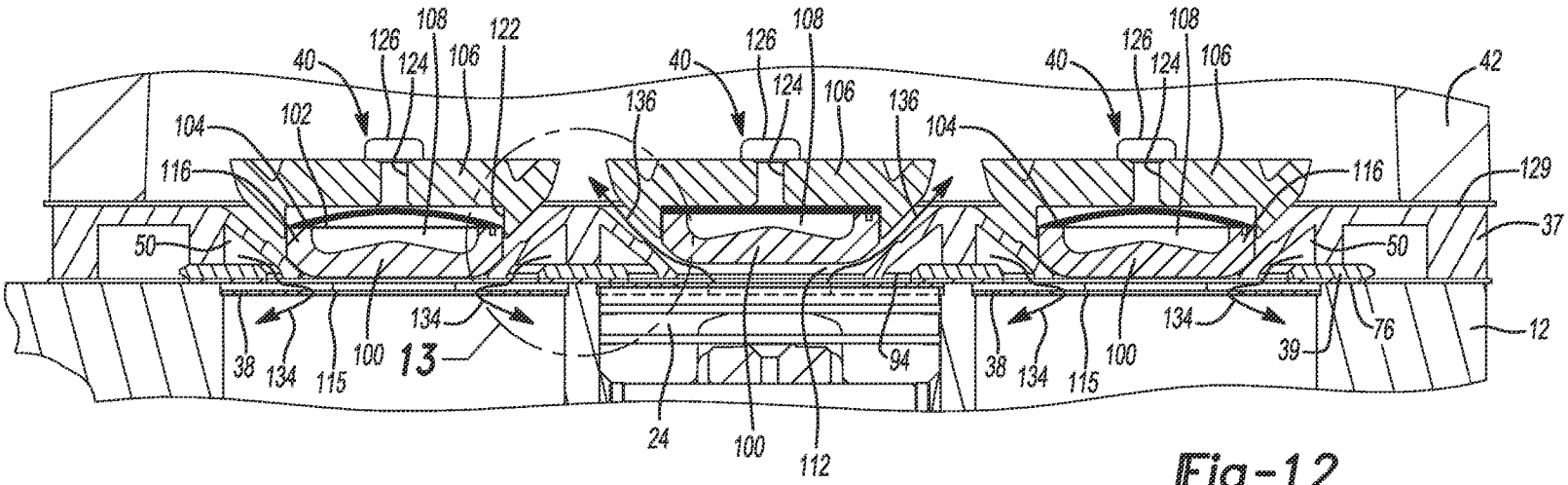
FIG. 12 is a cross-sectional view of a portion of the compressor assembly of FIG. 1 within an enclosed area 12 shown in FIG. 11.
Figure 13:
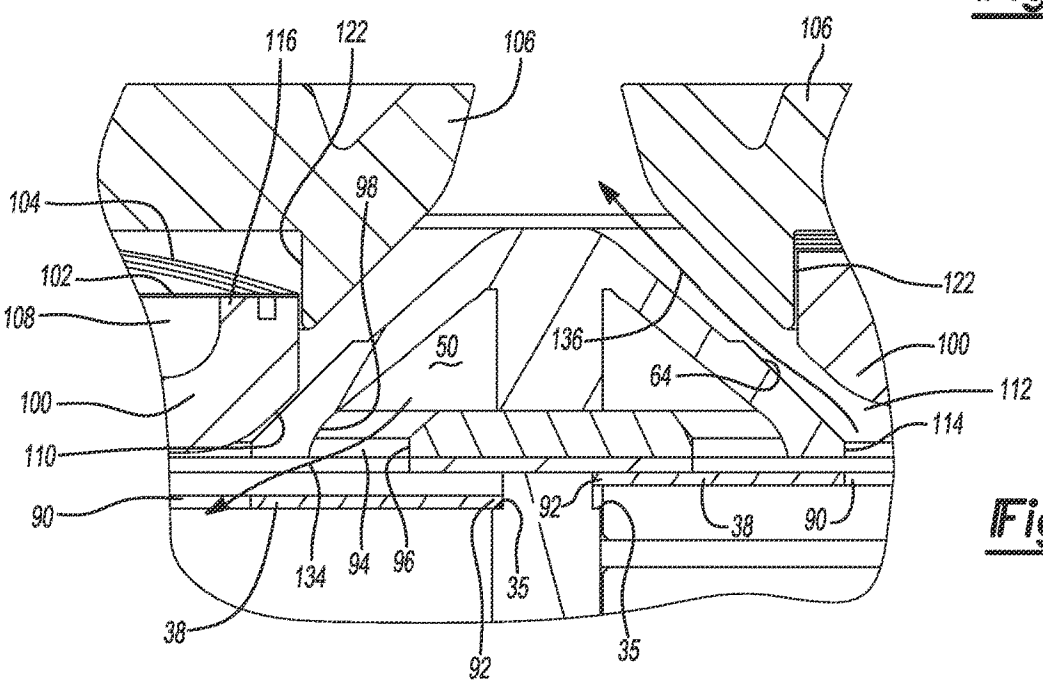
FIG. 13 is a cross-sectional view of a portion of the compressor assembly of FIG. 1 within an enclosed area 13 shown in FIG. 12.
Figure 14:
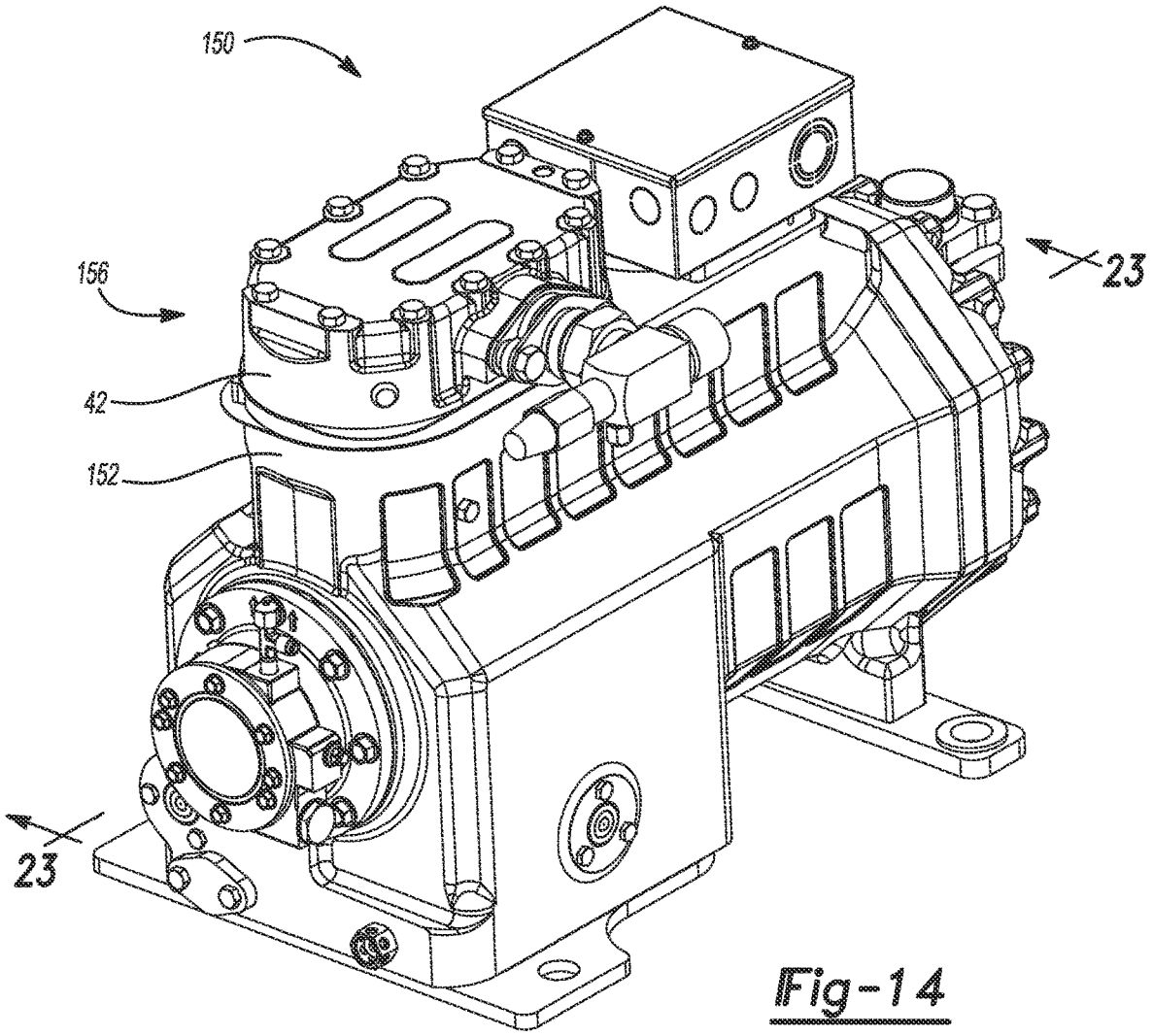
FIG. 14 is a perspective view of another compressor assembly according to the principles of the present disclosure.

As shown in FIGS. 2 and 3, the cylinder head assembly 26 includes a valve plate 37, one or more floating suction valves 38, a suction valve retainer 39, one or more cylinder discharge valve assemblies 40, a cylinder head 42, a compressor discharge valve 44, and a plurality of fasteners 46. The valve plate 37 is mounted to the first mounting surface 31 of the housing 12. A first gasket 48 may be disposed between the valve plate 37 and the first mounting surface 31 to provide a sealed relationship therebetween. The valve plate 37 cooperates with the second mounting surface 32 of the housing 12 and the suction valve retainer 39 to define a suction chamber 50 (FIGS. 12 and 13). The suction chamber 50 is an internal cavity that functions as a suction manifold that receives suction-pressure working fluid from the suction plenum 13 within the housing 12 through the suction passages 36 in the housing 12.

Figure 6:
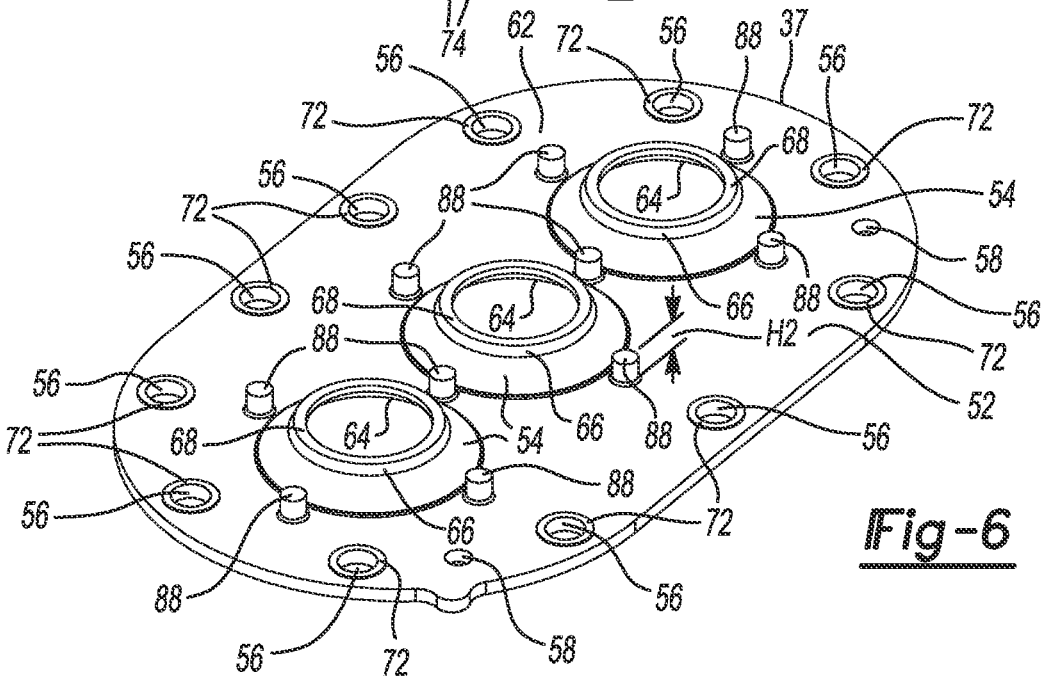
FIG. 6 is a bottom perspective view of a valve plate and posts of the compressor assembly of FIG. 1.
Figure 7:
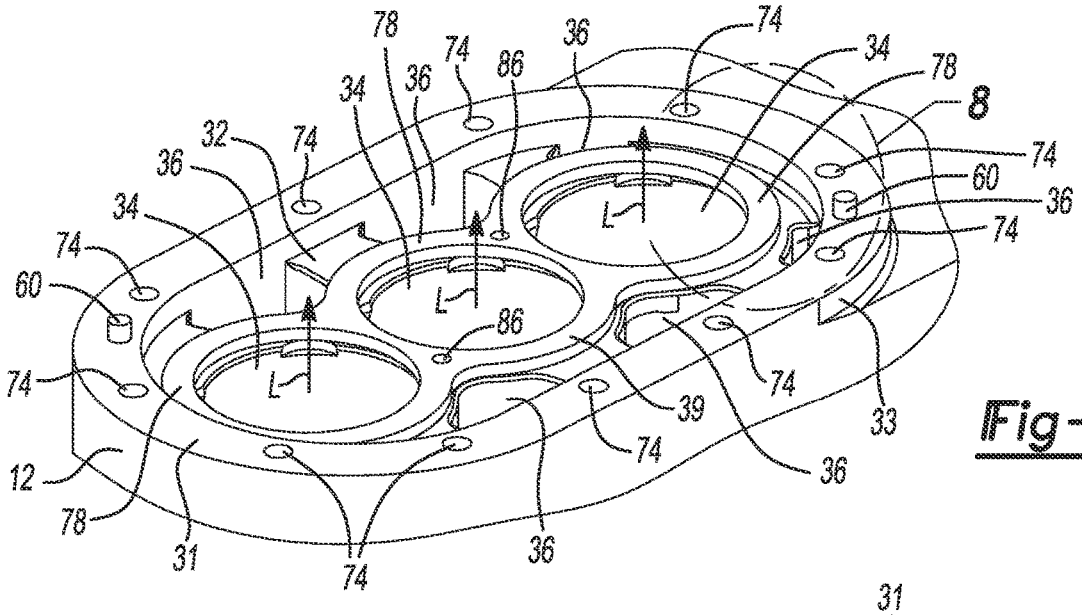
FIG. 7 is a perspective view of a suction valve retainer and dowels assembled to the housing of the compressor assembly of FIG. 1.
Figure 8:
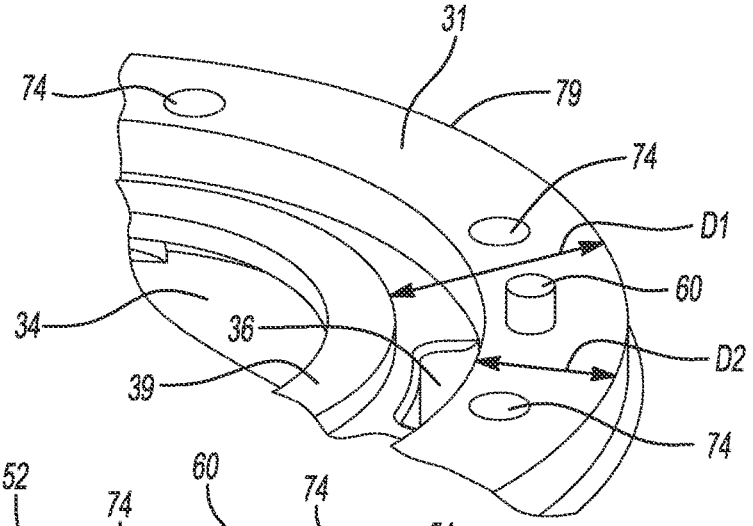
FIG. 8 is a perspective view of a portion of the compressor assembly of FIG. 1 within an enclosed area 8 shown in FIG. 7.
Figure 9:
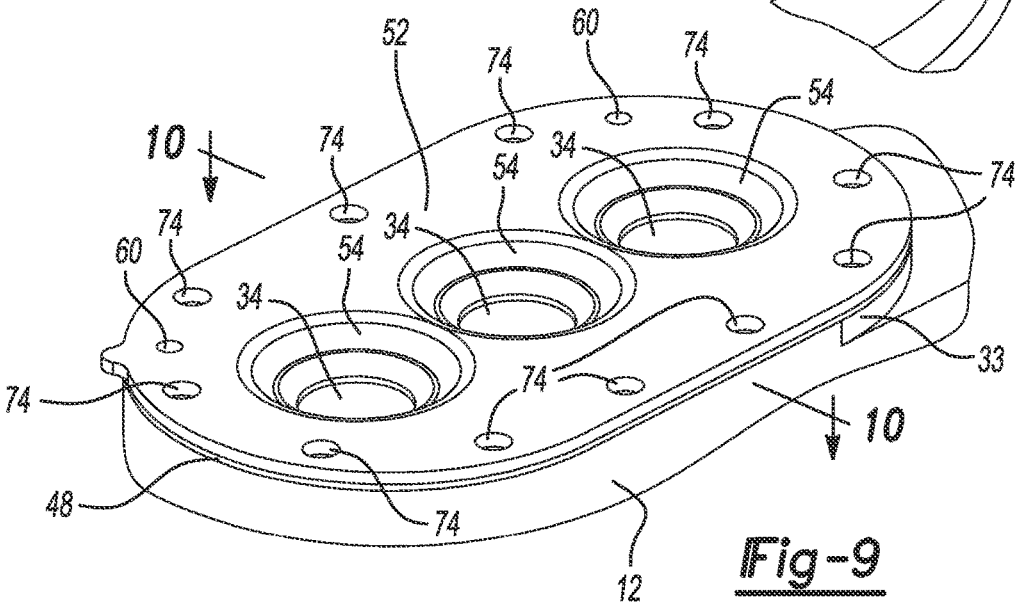
FIG. 9 is a perspective view of a valve plate assembled over the suction valve retainer on the housing of the compressor assembly of FIG. 1.

With reference to FIGS. 3, 6, and 9, the valve plate 37 is configured to separate suction-pressure working fluid entering the cylinders 22 from discharge-pressure working fluid exiting the cylinders 22. The valve plate 37 may be formed (e.g., stamped) from a metal (e.g., steel, aluminum) as a unitary body. The valve plate 37 includes an oval-shaped flat portion 52 and a plurality of hollow conical frustum portions 54 projecting from the flat portion 52. In the example shown, the flat portion 52 has an oval disk shape. The flat portion 52 of the valve plate 37 defines a plurality of holes 56 for receiving the fasteners 46, and a pair of holes 58 for receiving dowels 60 (FIGS. 7 and 8). The holes 56 are disposed about the entire perimeter of the flat portion 52, and the holes 58 are located at opposite corners of the flat portion 52.

The hollow conical frustum portions 54 project from a bottom surface 62 of the flat portion 52 and, when the valve plate 37 is mounted to the housing 12, the hollow conical frustum portions 54 extend toward the cylinders 22. A conical top surface 64 of each of the hollow conical frustum portions 54 defines a discharge valve seat for a corresponding one of the cylinders 22. Each of the hollow conical frustum portions 54 has a cylindrical bottom end 66. A bottom surface 68 of each the hollow conical frustum portions 54 is configured to engage a corresponding one of the suction valves 38 to hold the corresponding suction valve 38 in place when discharge-pressure working fluid is expelled from a corresponding one of the cylinders 22.

As best shown in FIG. 6, the valve plate 37 further includes a plurality of cylindrical collars 72 projecting from the bottom surface 62 of the flat portion 52. Each of the collars 72 is disposed about, and extends around the entire perimeter of, one of the holes 56. With additional reference to FIGS. 7 and 8, the collars 72 are configured to engage corresponding counterbores 74 in the housing 12 to locate the valve plate 37 relative to the housing 12 in an x-y plane that is parallel to the first mounting surface 31. When the valve plate 37 is assembled to the housing 12, the dowels 60 may first be inserted into holes 75 (FIGS. 3 and 4) in the first mounting surface 31 of the housing 12, and then inserted into the holes 58 in the valve plate 37 to locate the valve plate 37 relative to the housing 12 in the x-y plane. Then, the collars 72 may be inserted into the counterbores 74 in the housing 12 to maintain this location. In various implementations, the dowels 60 and the holes 58 and 75 may be omitted, and the collars 72 and the counterbores 74 may be the sole mechanism for locating the valve plate 37 relative to the housing 12 in the x-y plane.

With reference to FIGS. 3, 7, and 8, the suction valve retainer 39 is configured to retain the suction valves 38 within their respective suction valve seats. The suction valve retainer 39 may be formed (e.g., stamped) from a metal (e.g., steel, aluminum) as a unitary body. The suction valve retainer 39 is mounted to the second mounting surface 32 of the housing 12. A second gasket 76 may be disposed between the suction valve retainer 39 and the second mounting surface 32 to provide a sealed relationship therebetween. The suction valve retainer 39 includes, or consists of, overlapping annular disk portions 78. In addition, the suction valve retainer 39 has a top surface 80, a bottom surface 82, and holes 84 that extend through the top and bottom surfaces 80 and 82. The holes 84 are configured to receive dowels 86 for locating the suction valve retainer 39 relative to the housing 12 in an x-y plane parallel to the second mounting surface 32 of the housing 12.

Figure 10:
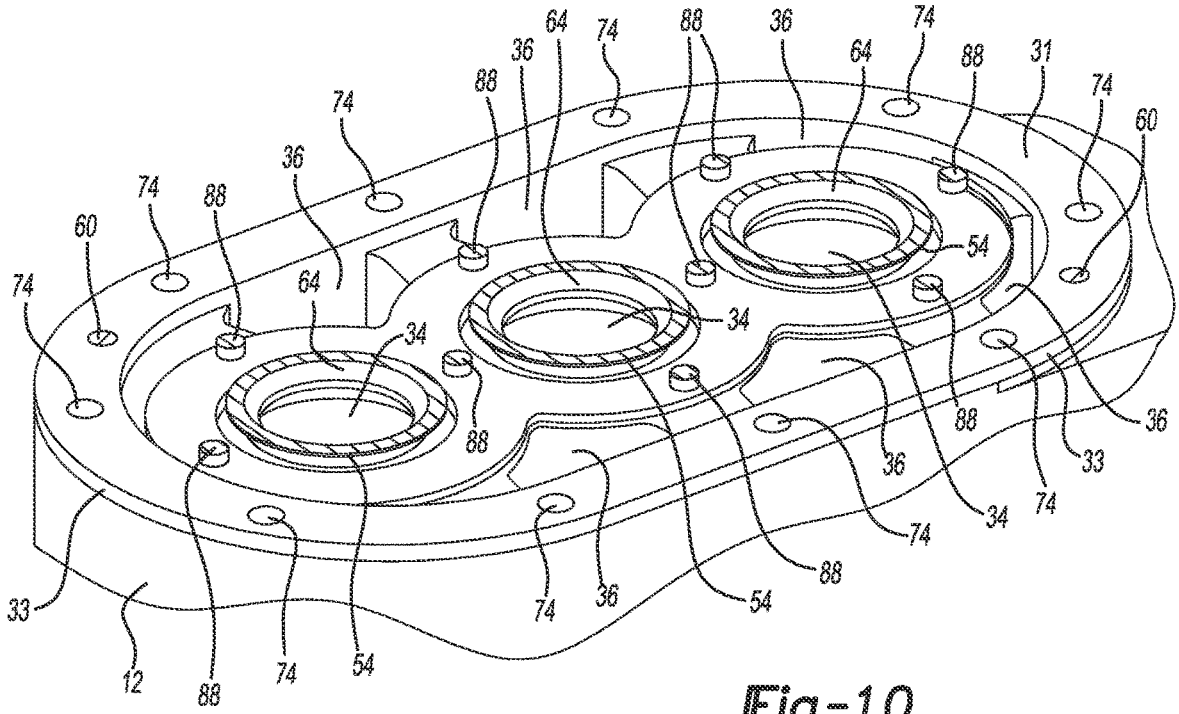
FIG. 10 is a sectioned perspective view of the valve plate, the suction valve retainer, and the dowels taken along a line 10-10 shown in FIG. 9.

Each annular disk portion 78 is disposed about, and extends entirely around, the longitudinal axis L of a corresponding one of the cylinders 22. In addition, as shown in FIG. 10, when the cylinder head assembly 26 is assembled to the housing 12, each of the annular disk portions 78 of the suction valve retainer 39 is concentrically aligned with a corresponding one of the hollow conical frustum portions 54 of the valve plate 37. Further, each annular disk portion 78 extends radially outward (i.e., relative to the longitudinal axes L of the cylinders 22) without extending beyond the suction passages 36 in the housing 12. In addition, the entire suction valve retainer 39 is configured to be located further away from an outer perimeter 79 of the first mounting surface 31 on the housing 12 than the suction passages 36. For example, as shown in FIG. 8, a first minimum distance D1 between the suction valve retainer 39 and the outer perimeter 79 is greater than a second minimum distance D2 between the suction passages 36 and the outer perimeter 79.

With reference to FIGS. 6 and 10, posts 88 may be disposed between the valve plate 37 and the suction valve retainer 39 to hold the suction valve retainer 39 in place as discharge-pressure working fluid is expelled from the cylinders 22. The posts 88 may be attached (e.g., brazed) to the bottom surface 62 of the flat portion 52 of the valve plate 37. However, the posts 88 may not be attached to the top surface 80 of the suction valve retainer 39. In this regard, the suction valve retainer 39 may be sandwiched between the posts 88 and the second mounting surface 32 of the housing 12 without actually attaching the suction valve retainer 39 to the valve plate 37. In various implementations, the posts 88 may be attached (e.g., brazed) to the top surface 80 of the suction valve retainer 39 instead of attaching the posts 88 the bottom surface 62 of the valve plate 37. The valve plate 37, the suction valve retainer 39, and/or the posts 88 collectively may be referred to as a valve plate assembly.

As shown in FIGS. 3 and 6, a height H1 of the annular projection 33 on the housing 12, or an amount by which the first mounting surface 31 is raised relative to the second mounting surface 32, may be greater than or equal to a sum of a thickness T1 of the suction valve retainer 39 and a height H2 of the posts 88. In one example, the height H1 of the annular projection 33 is greater than this sum and less than a sum of the thickness T1 of the suction valve retainer 39, the height H2 of the posts 88, a thickness T2 of the first gasket 48 before assembly, and a thickness T3 of the second gasket 76 before assembly. Thus, when the cylinder head assembly 26 is assembled to the housing 12, the first and second gaskets 48 and 76 are compressed to ensure a tight seal.

As shown in FIG. 3, the suction valves 38 may be thin, annular reed valves that include an annular main body 90 and a plurality of lobes 92 that extend radially outward (i.e., relative to the longitudinal axes L of the cylinders 22) from the main body 90. As shown in FIGS. 12 and 13, when the suction valve 38 is in an open position, at least a portion of each of the lobes 92 may be movably received in a corresponding one of the recesses 35 in the housing 12 such that the lobes 92 support the suction valve 38. Thus, in the open position, the suction valve 38 is seated in the suction valve seat formed by the recesses 35. Each suction valve 38 is movable between the open position, shown in the left and right cylinders 22 in FIG. 12, and a closed position, shown in the center cylinder 22 in FIG. 12. In the open position, each of the suction valves 38 allows suction-pressure working fluid to flow from the suction chamber 50 to a corresponding cylinder 22 through a corresponding annular suction port 94. Each suction port 94 is disposed between and defined by an outer radial surface 96 of the respective hollow conical frustum portion 54 of the valve plate 37 and an inner radial surface 98 of the respective annular disk portion 78 of the suction valve retainer 39.

In the closed position, each of the suction valves 38 restricts or prevents fluid flow from the suction chamber 50 to a corresponding cylinder 22 through the corresponding suction port 94. When each of the suction valves 38 is in the closed position, the main body 90 sealingly contacts the bottom surface 68 of the hollow conical frustum portion 54 of the valve plate 37. In addition, the lobes 92 sealingly contact the bottom surface 82 of the suction valve retainer 39. In this regard, the valve plate 37 and the suction valve retainer 39 are configured to engage the inner and outer perimeters of the suction valves 38, respectively, to limit upward movement of the suction valves 38 when discharge-pressure working fluid is expelled from the cylinders 22.

The bottom surface 68 of each hollow conical frustum portion 54 of the valve plate 37 may be flush with, or coplanar with, the bottom surface 82 of the suction valve retainer 39 such that the main body 90 sealingly contacts the bottom surfaces 68 of the valve plate 37 when the lobes 92 sealingly contact the bottom surface 82 of the suction valve retainer 39. In this regard, the valve plate 37 and the suction valve retainer 39 may be preassembled to one another using a fixture to maintain the bottom surface 82 of the suction valve retainer 39 within the same plane as the bottom surfaces 68 of the valve plate 37. The bottom surfaces 68 of the valve plate 37 and bottom surface 82 of the suction valve retainer 39 may then be machined at the same time to ensure that the bottom surfaces 68 and 82 are flush with, or coplanar with, one another.

While the figures depict each cylinder 22 having a plurality of discrete recesses 35, in some configurations, each cylinder 22 could have a single continuous recess 34 that extends angularly around the inner diametrical surface 28 of the cylinder 22. In such configurations, the suction valves 38 may not include any of the lobes 92. It will be appreciated, however, that each cylinder 22 could have any number of recesses 35 and the suction valves 38 could have any number of the lobes 92. The recesses 35 and lobes 92 can be shaped in any suitable manner.

As shown in FIGS. 3, 12, and 13, each of the cylinder discharge valve assemblies 40 includes a discharge valve 100, a spacer 102, a biasing member 104, and a discharge valve retainer 106. The discharge valve 100 may have a shape similar to a discus puck with an open end 108. In addition, the discharge valve 100 may have a beveled edge 110 that conforms to the conical top surface 64 of valve plate 37 that forms the corresponding discharge valve seat. The discharge valve 100 may be formed from PEEK (polyetheretherketone) or any other suitable material.

The discharge valve 100 is movable between a closed position, shown in the left and right cylinders 22 in FIG. 12, and an open position, shown in the center cylinder 22 in FIG. 12. In the closed position, the discharge valve 100 sealingly contacts the conical top surface 64 of valve plate 37 that forms the corresponding discharge valve seat, thereby restricting or preventing fluid flow through a discharge port 112. In the open position, the discharge valve 100 is spaced apart from the conical top surface 64 of the valve plate 37 that forms the corresponding discharge valve seat, thereby allowing fluid flow from the cylinder 22 through the discharge port 112.

The discharge port 112 is defined by an inner radial surface 114 of the corresponding cylindrical bottom end 66 of the valve plate 37 and by the conical top surface 64 of valve plate 37. As shown in FIG. 3, an aperture 115 extends through the main body 90 of each suction valve 38. The aperture 115 in each suction valve 38 may be concentrically aligned with a corresponding one of the discharge ports 112 such that discharge-pressure working fluid can flow from the cylinders 22 through the apertures 115 and into the discharge ports 112.

As shown in FIGS. 12 and 13, the biasing member 104 applies a biasing force to the discharge valve 100 to bias the discharge valve 100 toward the conical top surface 64 of the valve plate 37 that forms the corresponding discharge valve seat. The biasing member 104 may be a crimp spring as shown. The discharge valve 100 may seat against the corresponding discharge valve seat when a force acting on the discharge valve 100 due to pressure in the compression chamber 27 is less than the biasing force applied to the discharge valve 100 by the biasing member 104. The spacer 102 is disposed between the biasing member 104 and the discharge valve 100 and may distribute the biasing force applied by the biasing member 104 around a top surface 116 of the discharge valve 100. The spacer 102 and the biasing member 104 may be formed from metal.

The discharge valve retainer 106 retains the discharge valve 100 in the vicinity of the conical top surface 64 of the valve plate 37 that forms the corresponding discharge valve seat. As shown in FIGS. 3, 12, and 13, the discharge valve retainer 106 includes a conical main body portion 118 and ears 120 extending from opposite sides of the main body portion 118. An outer radial surface 121 of the main body portion 118 conforms to the conical top surface 64 of valve plate 37 that forms the corresponding discharge valve seat. The main body portion 118 defines a cylindrical pocket 122 within which the discharge valve 100 moves between the open and closed positions. A plurality of holes 124 may extend through the main body portion 118 to allow discharge-pressure working fluid to flow through the discharge valve retainer 106. Fasteners 126 may be inserted through holes (not shown) in the ears 120 of the discharge valve retainer 106 and through corresponding holes (not shown) in the valve plate 37 to attach the discharge valve retainer 106 to the valve plate 37.

As shown in FIGS. 2 and 11, the cylinder head 42 fits over the valve plate 37 and cooperates with the valve plate 37 to define a discharge chamber 128. The valve plate 37 forms the bottom wall of the discharge chamber 128, and the cylinder head 42 forms the sidewall and top wall of the discharge chamber 128. A third gasket 129 may be disposed between the cylinder head 42 and the valve plate 37 to provide a sealed relationship therebetween. The discharge chamber 128 receives discharge-pressure working fluid from the compression chambers 27 through the discharge valve 100 when the discharge valve 100 is in the open position. The discharge-pressure working fluid in the discharge chamber 128 may exit the compressor 10 through the compressor discharge valve 44, which may be connected to a condenser or gas cooler (not shown).

In the example shown, the cylinder head 42 has a bowl shape with an oval-shaped outer perimeter that matches the oval-shaped outer perimeter of the valve plate 37 and the oval-shaped outer perimeter 79 of the first mounting surface 31 on the housing 12. The cylinder head 42 has a plurality of holes 130 disposed about the perimeter of the cylinder head 42 and extending therethrough. To assemble the cylinder head assembly 26 to the housing 12, the fasteners 46 are inserted through the holes 130 in the cylinder head 42, through corresponding holes 132 in the third gasket 129, through the holes 56 in the valve plate 37, through corresponding holes 133 in the first gasket 48, and into the counterbores 74 in the housing 12. The fasteners 46 may have external threads (not shown) that engage internal threads (not shown) in the counterbores 74 for tightening and retaining the fasteners 46. Notably, the fasteners 46 do not extend through the suction valve retainer 39 when the cylinder head assembly 26 is assembled to the housing 12.

As shown in FIGS. 11 and 12, the holes 124 extending through each discharge valve retainer 106 place the cylindrical pocket 122 in each discharge valve retainer 106 in fluid communication with the discharge chamber 128. Thus, discharge-pressure working fluid in the discharge chamber 128 may assist the biasing member 104 in biasing each discharge valve 100 toward the corresponding discharge valve seat. Therefore, the discharge valve 100 may seat against the corresponding discharge valve seat when a force acting on the discharge valve 100 due to pressure in the compression chamber 27 is less than a sum of the biasing force of the biasing member 104 and the biasing force of discharge-pressure working fluid in the discharge chamber 128.

With reference to FIGS. 4, 5, 7, 8, and 10-13, operation of the compressor 10 will be described in detail. Suction-pressure working fluid may enter the compressor 10 through a suction port (not shown) in the housing 12. From the suction port, the suction-pressure working fluid may enter the suction plenum 13 (FIG. 11) within the housing 12. From the suction plenum 13, the suction-pressure working fluid may be drawn into the suction chamber 50 (FIGS. 12 and 13) via the suction passages 36 (FIGS. 4, 5, 7, 8, and 10) in the housing 12.

During the suction stroke of one of the pistons 24 within a corresponding cylinder 22 (i.e., while the piston 24 is moving away from the cylinder head assembly 26), low fluid pressure within the compression chamber 27 will cause the suction valve 38 to move into the open position (i.e., where the lobes 92 contact the recesses 35). Movement of the suction valve 38 into the open position allows the working fluid in the suction chamber 50 to flow into the compression chamber 27 through the suction port 94 as indicated by the arrows labeled 134 in FIG. 13. Because the outer diameter of the main body 90 of the suction valve 38 is less than the inner diameter of the cylinder 22 and because the main body 90 has the aperture 115, suction-pressure working fluid from the suction port 94 can flow around the outside of the main body 90 and through the aperture 115, thereby improving fluid flow into the compression chamber 27.

The low fluid pressure within the compression chamber 27 during the suction stroke of the piston 24 also causes the discharge valve 100 to move into the closed position (i.e., where the discharge valve 100 contacts the conical top surface 64 of valve plate 37 that forms the discharge valve seat), thereby restricting or preventing fluid flow between the compression chamber 27 and the discharge chamber 128. As described above, the discharge valves 100 move between the open and closed positions within the cylindrical pockets 122 defined in the discharge valve retainers 106.

After drawing suction-pressure working fluid into the compression chamber 27 during the suction stroke, the piston 24 moves back toward the cylinder head assembly 26 in a compression stroke. At the start of the compression stroke, increased fluid pressure within the compression chamber 27 (i.e., to a level higher than the fluid pressure within the suction chamber 50) forces the floating suction valve 38 upward toward the bottom surface 68 of the valve plate 37 and the bottom surface 82 of the suction valve retainer 39. As the suction valve 38 moves between its open and closed positions, the suction valve 38 is floating, i.e., the suction valve 38 is not retained by any solid structure above or below the suction valve 38. The higher fluid pressure within the compression chamber 27 during the compression stroke will retain the suction valve 38 in contact with the bottom surfaces 68 and 82 to restrict or prevent fluid flow between the compression chamber 27 and the suction chamber 50.

The very short distance that the suction valves 38 must travel between the fully open and fully closed positions allows for nearly instantaneous opening and closing of the suction ports 94, which improves efficiency and performance of the compressor 10. The thin structure and low mass of the suction valves 38 requires less work to move than conventional suction valves, which also improves efficiency and performance of the compressor 10. Furthermore, the manner in which the suction valves 38 interact with the recesses 35 allows the suction valves 38 to be installed and operate with pins, fasteners or retainers. This structure also simplifies manufacturing and assembly of the compressor 10.

Increasing fluid pressure within the compression chamber 27 during the compression stroke of the piston 24 also causes the discharge valve 100 to move into the open position (i.e., where the discharge valve 100 is spaced apart from the conical top surface 64 of the valve plate 37 that forms the corresponding discharge valve seat), thereby allowing compressed working fluid in the compression chamber 27 to flow through the discharge port 112 and into the discharge chamber 128 as indicated by the arrow labeled 136 in FIG. 13.

Referring now to FIGS. 14-17, a compressor 150 is substantially similar to the compressor 10 such that only differences between the compressors 10 and 150 will now be described. The compressor 150 includes a shell or housing 152 that is similar to the housing 12 of the compressor 10 except that the housing 152 does not have two different mounting surfaces such as the first and second mounting surfaces 31 and 32 of the housing 12. Instead, the compressor 150 includes a single, continuous flat mounting surface 154 on which a cylinder head assembly 156 is mounted. Thus, the housing 152 does not include a projection such as the annular projection 33 that projects from the second mounting surface 32 of the housing 12 to define the first mounting surface 31.

The cylinder head assembly 156 is substantially similar to the cylinder head assembly 26 except that the cylinder head assembly 156 includes a valve plate 158 in place of the valve plate 37 and the suction valve retainer 39. The valve plate 158 may be formed (e.g., casted) from metal (e.g., steel, aluminum) as a unitary body, and the valve plate 158 may be referred to as a valve plate assembly. In addition, the cylinder head assembly 156 includes a single fourth gasket 160 in place of the first and second gaskets 48 and 76 of the cylinder head assembly 26. The valve plate 158 is mounted to the mounting surface 154, and the fourth gasket 160 is disposed between the valve plate 158 and the mounting surface 154 to provide a sealed relationship therebetween. The valve plate 158 cooperates with the mounting surface 154 of the housing 152 to define a suction chamber 161 (FIGS. 19, 21, 22, and 24). The suction chamber 161 is an internal cavity that functions as a suction manifold that receives suction-pressure working fluid from the suction plenum 13 within the housing 152 through the suction passages 36 in the housing 12.

Figure 18:
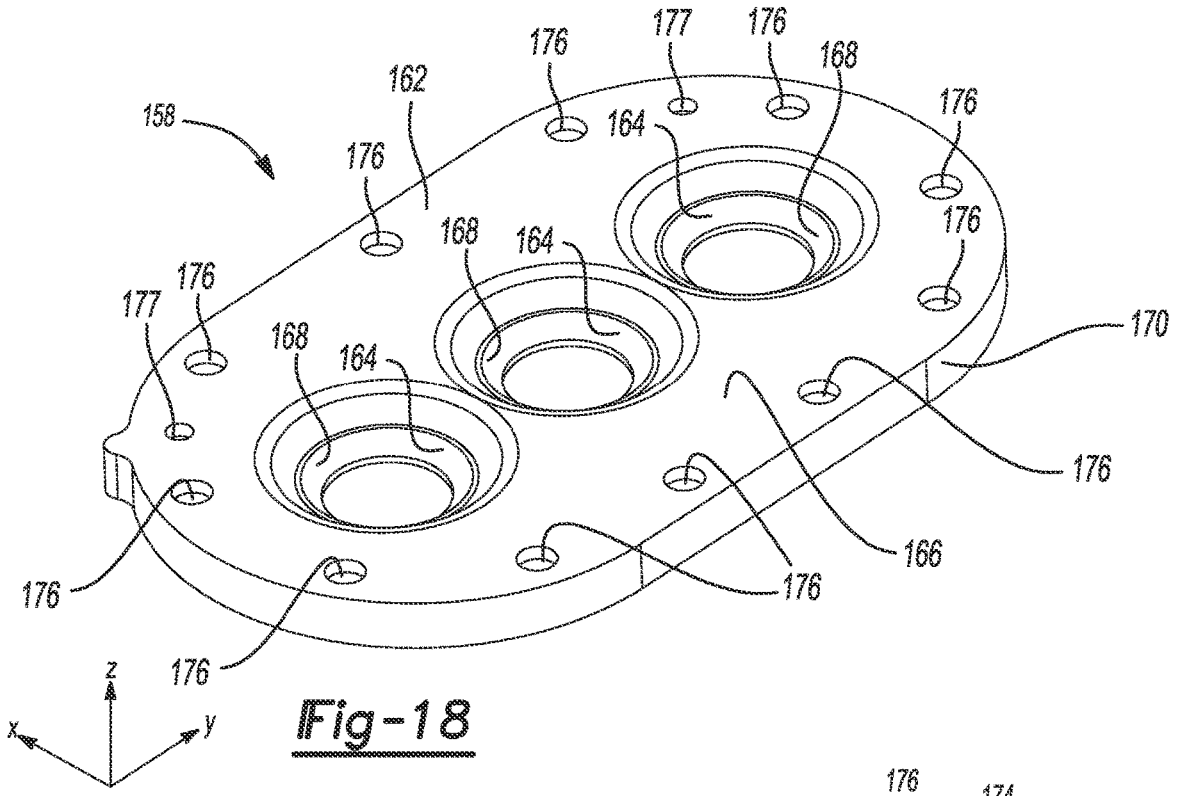
FIG. 18 is a top perspective view of a valve plate assembly of the compressor assembly of FIG. 14.
Figure 19:
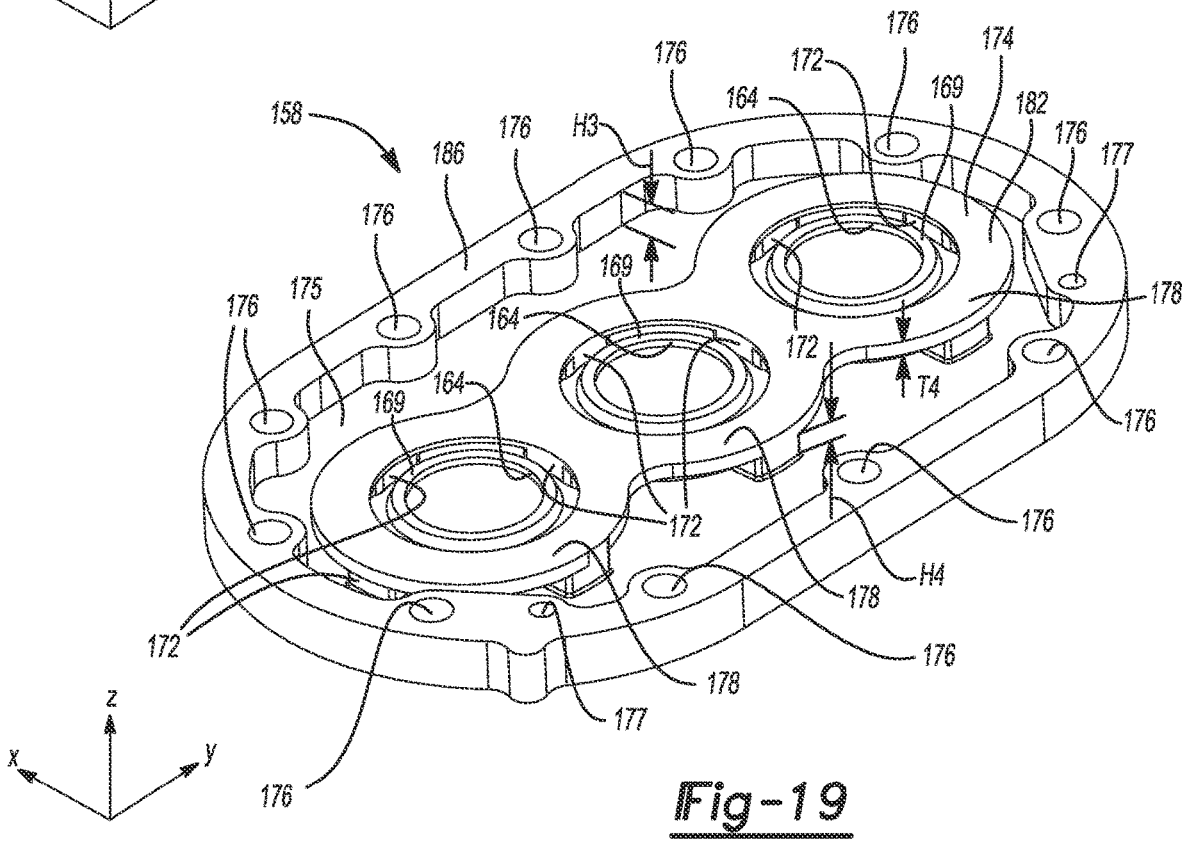
FIG. 19 is a bottom perspective view of the valve plate assembly of the compressor assembly of FIG. 14.
Figure 20:
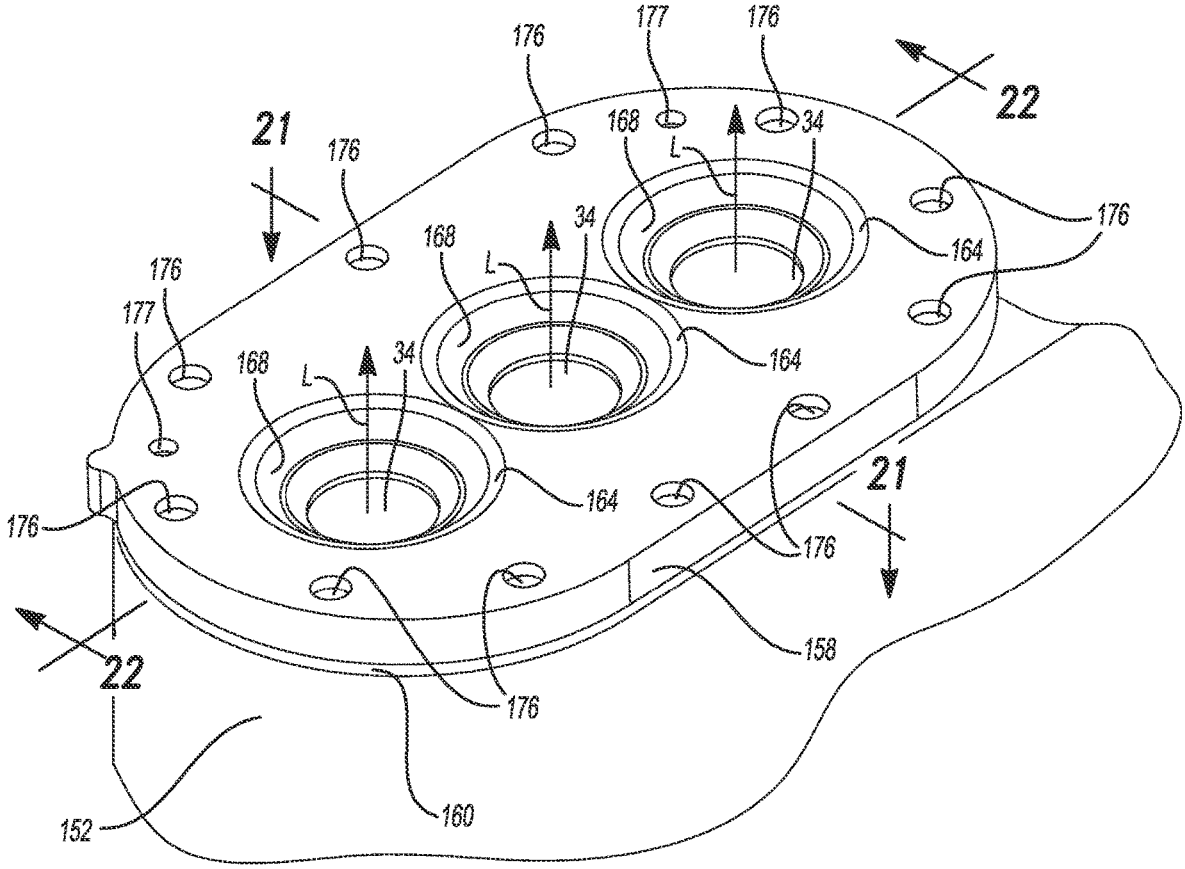
FIG. 20 is a perspective view of the valve plate assembly assembled to the housing of the compressor assembly of FIG. 14.
Figure 21:
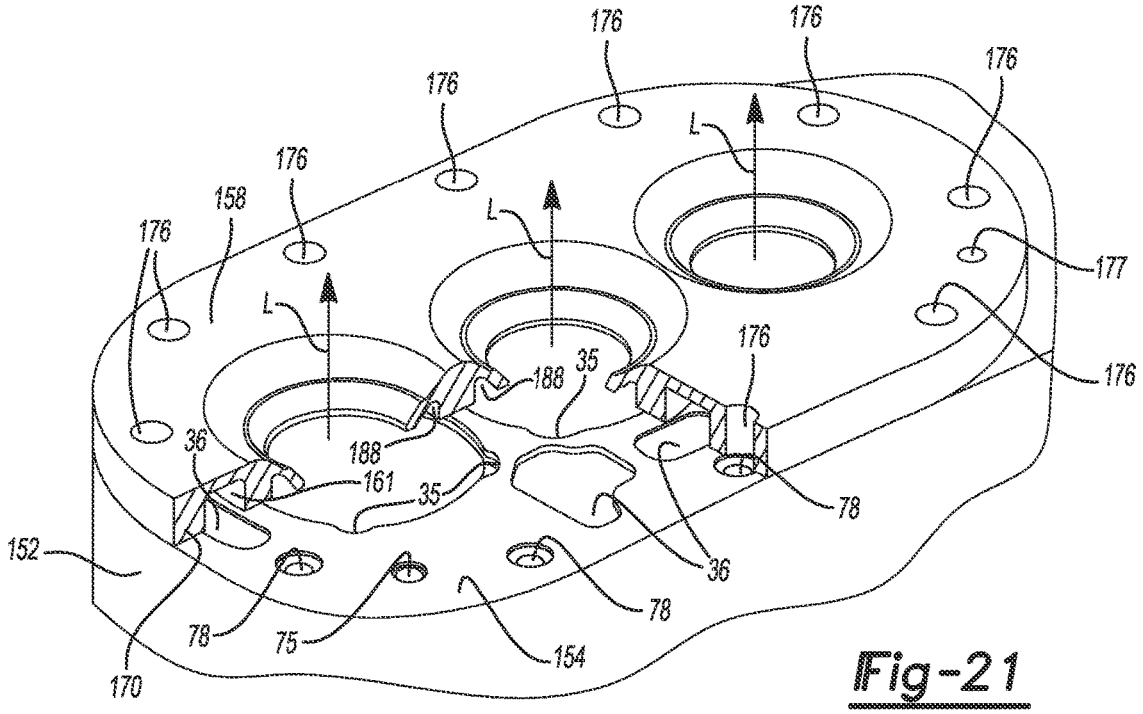
FIG. 21 is a sectioned perspective view of the valve plate assembly and the housing of the compressor assembly of FIG. 14 taken along a line 21-21 shown in FIG. 20.

Like the valve plate 37 of the compressor 10, the valve plate 158 is configured to separate suction-pressure working fluid entering the cylinders 22 from discharge-pressure working fluid exiting the cylinders 22. As shown in FIGS. 18 and 19, the valve plate 158 includes an oval-shaped flat portion 162 and a plurality of hollow conical frustum portions 164 projecting from the flat portion 52. The flat portion 162 and the hollow conical frustum portions 164 of the valve plate 158 are similar to the flat portion 52 and the hollow conical frustum portions 54 of the valve plate 37. The flat portion 162 has a flat top surface 166 and each of the hollow conical frustum portions 164 has a conical top surface 168. Each of the conical top surfaces 168 forms a discharge valve seat against which the discharge valve 100 selectively seats. In addition, each of the hollow conical frustum portions 164 has a flat bottom surface 169 against which a corresponding suction valve 38 selectively seats.

The valve plate 158 further includes an oval annular projection 170, a plurality of posts 172, and a suction valve retainer 174. The oval annular projection 170 projects from a bottom surface 175 of the flat portion 162 and is disposed about the entire perimeter of the flat portion 162. The annular projection 170 of the compressor 150 is similar to the annular projection 33 of the compressor 10. However, the annular projection 33 is integrated into the housing 12, while the annular projection 170 is integrated into the valve plate 158.

A first plurality of holes 176 extend through the flat portion 162 and through the annular projection 170, and are disposed about the entire perimeter of the valve plate 158. The holes 176 are configured to receive the fasteners 46 (FIG. 15) for attaching the cylinder head assembly 156 to the housing 152. A pair of holes 177 also extend through the flat portion 162 and through the annular projection 170, and are disposed at opposite ends of the valve plate 158. The holes 177 are configured to receive the dowels 60 for locating the valve plate 158 relative to the housing 152 in an x-y plane parallel to the mounting surface 154.

Figure 22:
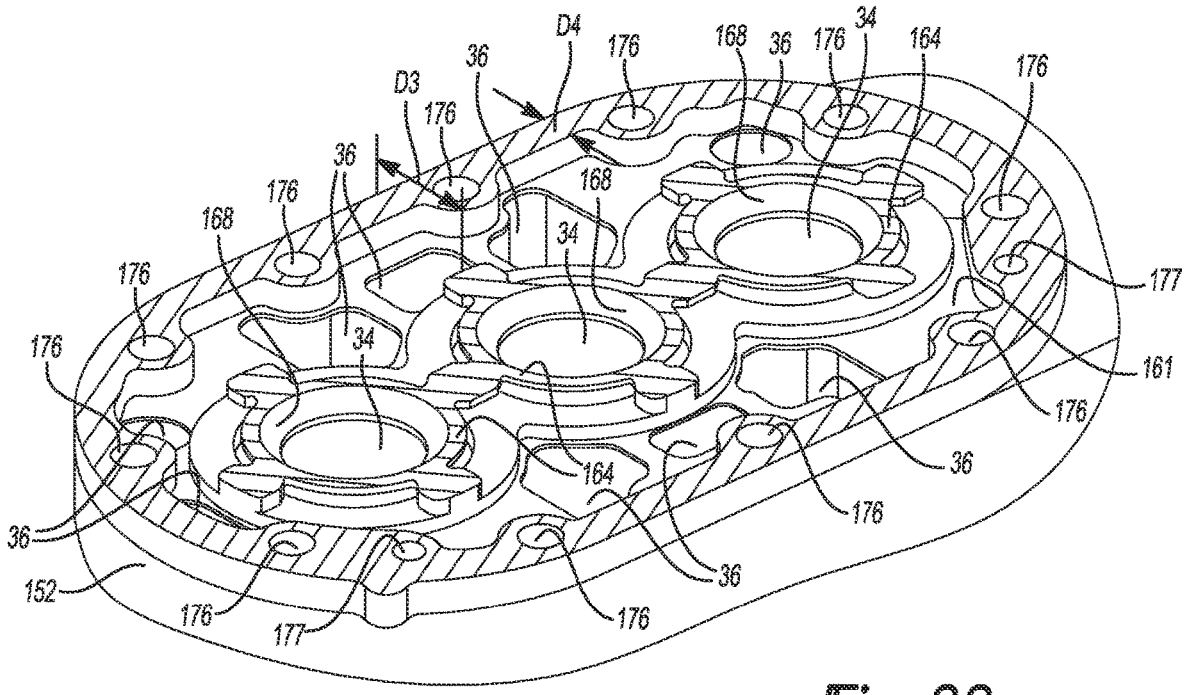
FIG. 22 is a sectioned perspective view of the valve plate assembly and the housing of the compressor assembly of FIG. 14 taken along a line 22-22 shown in FIG. 20.

The posts 172 also project from the bottom surface 175 of the flat portion 162, and the posts 172 are disposed every 90 degrees about each of the hollow conical frustum portions 164. The posts 172 attach the suction valve retainer 174 to the flat portion 162. The posts 172 are similar to the posts 88 of the compressor 10 except that the posts 172 are formed integrally with the remainder of the valve plate 158, while the posts 88 are formed separate from the valve plate 37 and attached thereto. In addition, the posts 172 are attached to both the flat portion 162 and the suction valve retainer 174, while the posts 88 are only attached to the flat portion 52. Further, as shown in FIG. 22, each of the posts 172 may have a hexagonal cross section, while the posts 88 have a circular cross section.

Like the suction valve retainer 39, the suction valve retainer 174 is configured to retain the suction valves 38 within their respective suction valve seats, which are formed by the recesses 35 in the housing 152. As shown in FIGS. 19 and 22, the suction valve retainer 174 includes, or consists of, overlapping annular disk portions 178 similar to the overlapping annular disk portions 78 of the suction valve retainer 39. In addition, the suction valve retainer 174 has top and bottom surfaces 180 and 182 similar to the top and bottom surfaces 80 and 82 of the suction valve retainer 39. However, the suction valve retainer 174 is formed integrally with the remainder of the valve plate 158, while the suction valve retainer 39 is formed separate from the valve plate 37 and is not attached to the valve plate 37. In addition, the suction valve retainer 174 does not have holes similar to the holes 84 in the suction valve retainer 39 for receiving the dowels 86 to locate the suction valve retainer 39 in the x-y plane. To this end, since the suction valve retainer 174 is fixed to the flat portion 162 via the posts 172, locating the flat portion 162 relative to the housing 152 in the x-y plane also locates the suction valve retainer 174 relative to the housing 152 in the x-y plane.

Like the annular disk portions 78 of the compressor 10, each annular disk portion 178 is disposed about, and extends entirely around, the longitudinal axis L of a corresponding one of the cylinders 22. In addition, each annular disk portion 178 extends radially outward (i.e., relative to the longitudinal axes L of the cylinders 22) without extending beyond the suction passages 36 in the housing 12. Further, the entire suction valve retainer 174 is configured to be located further away from an outer perimeter 184 of the mounting surface 154 on the housing 152 than the suction passages 36. For example, as shown in FIG. 22, a first minimum distance D3 between the suction valve retainer 174 and the outer perimeter 184 is greater than a second minimum distance D4 between the suction passages 36 and the outer perimeter 184.

As shown in FIG. 19, a height H3 of the annular projection 130 on the valve plate 158, or an amount by which a bottom surface 186 of the annular projection 130 is lowered relative to the bottom surface 175 of the flat portion 162 of the valve plate 158, may be greater than or equal to a sum of a thickness T4 of the suction valve retainer 174 and a height H4 of the posts 172. In one example, the height H3 of the annular projection 130 is greater than this sum and less than a sum of the thickness T4 of the suction valve retainer 174, the height H4 of the posts 172, and a thickness T5 (FIG. 16) of the fourth gasket 160 before assembly. Thus, when the cylinder head assembly 156 is assembled to the housing 152, the fourth gasket 160 is compressed to ensure a tight seal.

The bottom surface 169 of each hollow conical frustum portion 164 of the valve plate 158 may be flush with, or coplanar with, the bottom surface 182 of the suction valve retainer 174 such that the main body 90 of the suction valve 38 sealingly contacts the bottom surfaces 169 of the valve plate 158 when the lobes 92 of the suction valve 38 sealingly contact the bottom surface 182 of the suction valve retainer 174. In addition, the bottom surface 186 of the annular projection 170 may be flush with, or coplanar with, the bottom surfaces 169 of the valve plate 158 and the bottom surface 182 of the suction valve retainer 174. The bottom surfaces 169 of the valve plate 158, the bottom surface 182 of the suction valve retainer 174, and the bottom surface 186 of the annular projection 170 may be machined at the same time to ensure that the bottom surfaces 169, 182, and 186 are flush with, or coplanar with, one another.

Figure 24:
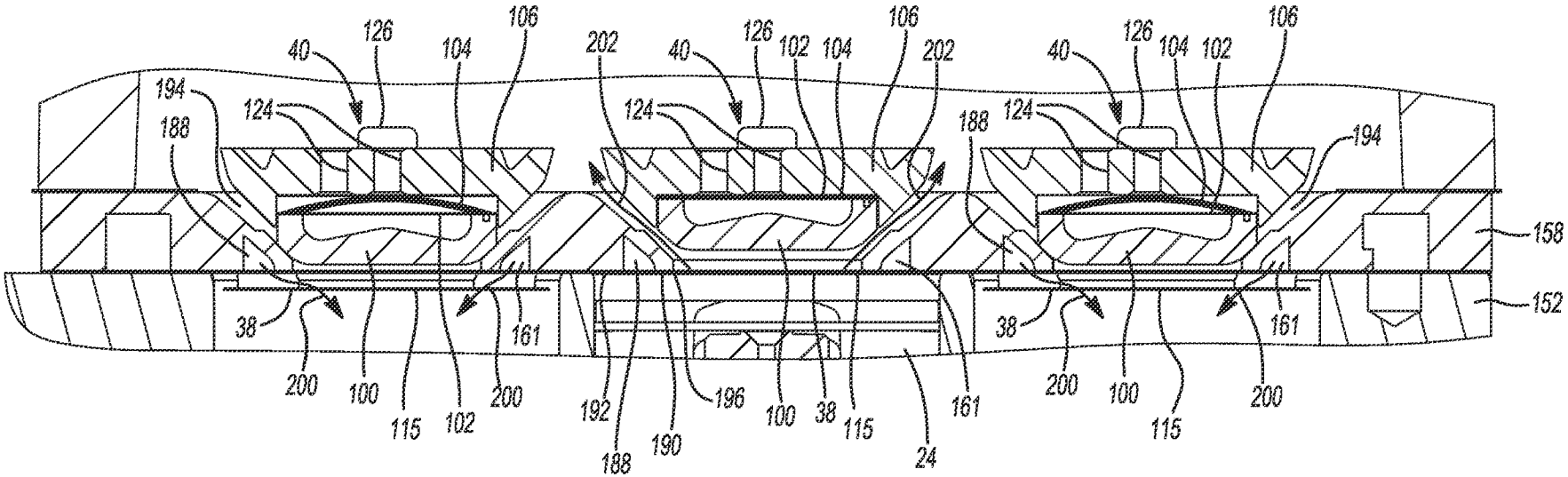
FIG. 24 is a cross-sectional view of a portion of the compressor assembly of FIG. 14 within an enclosed area 24 shown in FIG. 23.

In the compressor 150, like the compressor 10, each suction valve 38 is movable between an open position, shown in the left and right cylinders 22 in FIG. 24, and a closed position, shown in the center cylinder 22 in FIG. 24. In the open position, each of the suction valves 38 allows suction-pressure working fluid to flow from the suction chamber 161 to a corresponding cylinder 22 through a corresponding annular suction port 188. Each suction port 188 is disposed between and defined by an outer radial surface 190 of the respective hollow conical frustum portion 164 of the valve plate 158 and an inner radial surface 192 of the respective annular disk portion 178 of the valve plate 158.

In the closed position, each of the suction valves 38 restricts or prevents fluid flow from the suction chamber 161 to a corresponding cylinder 22 through the corresponding suction port 188. When each suction valve 38 is in the closed position, the main body 90 of the suction valve 38 sealingly contacts the bottom surface 169 of the hollow conical frustum portion 164 of the valve plate 158. In addition, the lobes 92 of the suction valve 38 sealingly contact the bottom surface 182 of the suction valve retainer 174. In this regard, the hollow conical frustum portion 164 and the suction valve retainer 174 are configured to engage the inner and outer perimeters of the suction valves 38, respectively, to limit upward movement of the suction valves 38 when discharge-pressure working fluid is expelled from the cylinders 22.

In the compressor 150, like the compressor 10, the discharge valve 100 is movable between a closed position, shown in the left and right cylinders 22 in FIG. 24, and an open position, shown in the center cylinder 22 in FIG. 24. In the closed position, the discharge valve 100 sealingly contacts the conical top surface 168 of valve plate 158 that forms the corresponding discharge valve seat, thereby restricting or preventing fluid flow through a discharge port 194. In the open position, the discharge valve 100 is spaced apart from the conical top surface 168 of the valve plate 158, thereby allowing fluid flow from the cylinder 22 through the discharge port 194.

The discharge port 194 is defined by an inner radial surface 196 of the corresponding hollow conical frustum portion 164 of the valve plate 158 and by the conical top surface 168 of the corresponding hollow conical frustum portion 164. As shown in FIG. 24, the aperture 115 in each suction valve 38 may be concentrically aligned with a corresponding one of the discharge ports 194 such that discharge-pressure working fluid can flow from the cylinders 22 through the apertures 115 and into the discharge ports 194.

Figure 15:
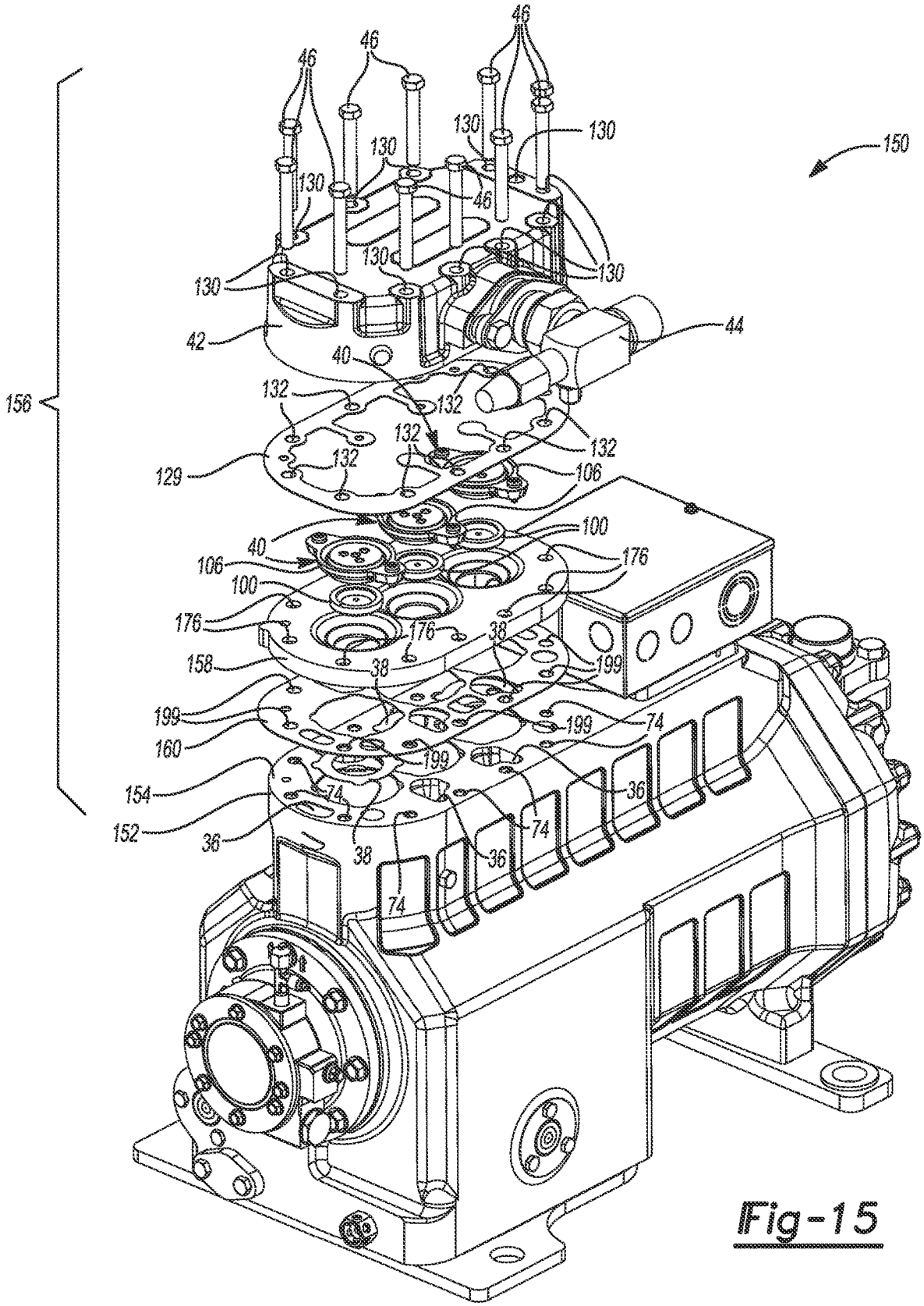
FIG. 15 is a partially exploded perspective view of the compressor assembly of FIG. 14.
Figures 16, 17:
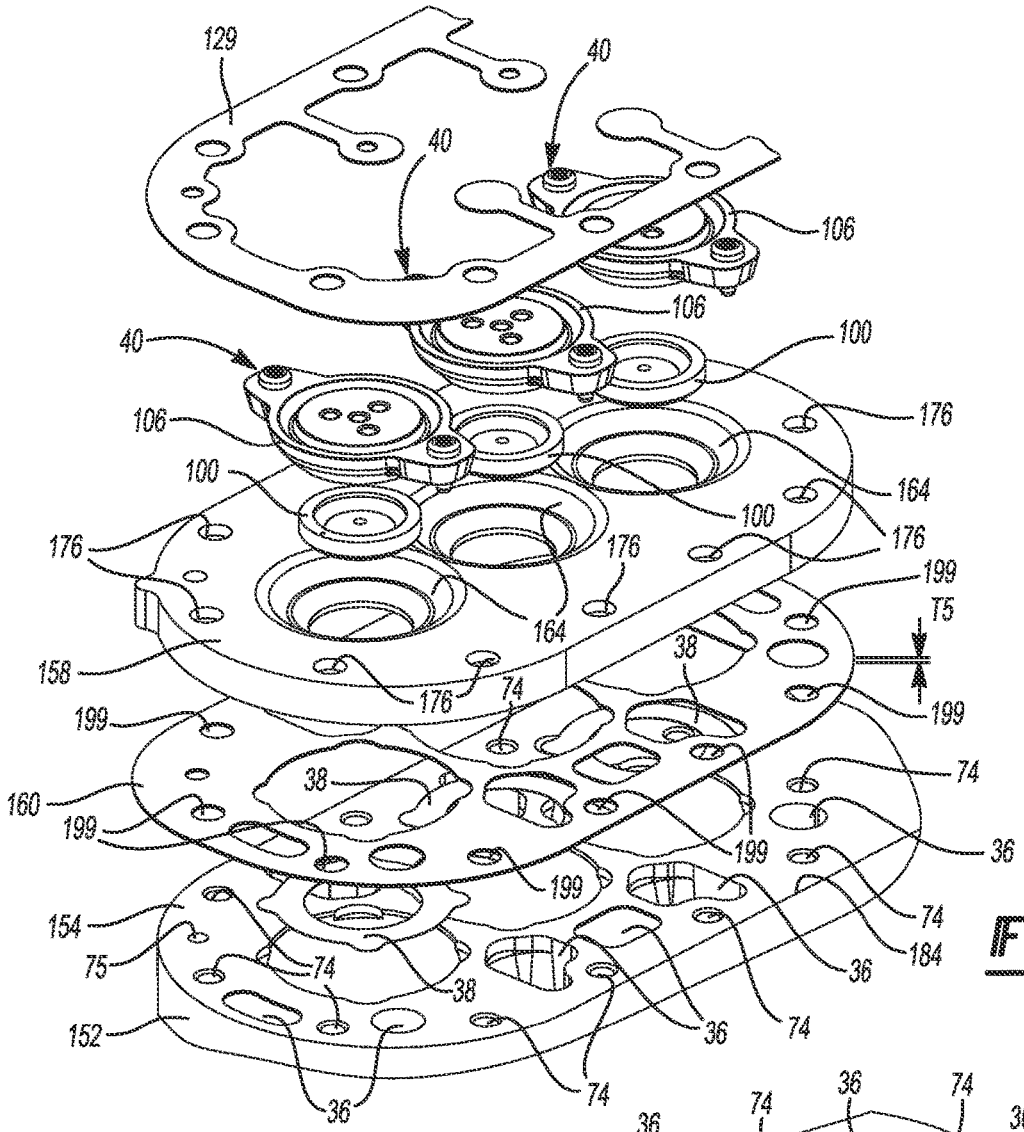
FIG. 16 is an exploded perspective view of a portion of the compressor assembly of FIG. 14.
FIG. 17 is a perspective view of a shell or housing of the compressor assembly of FIG. 14.
Figure 23:
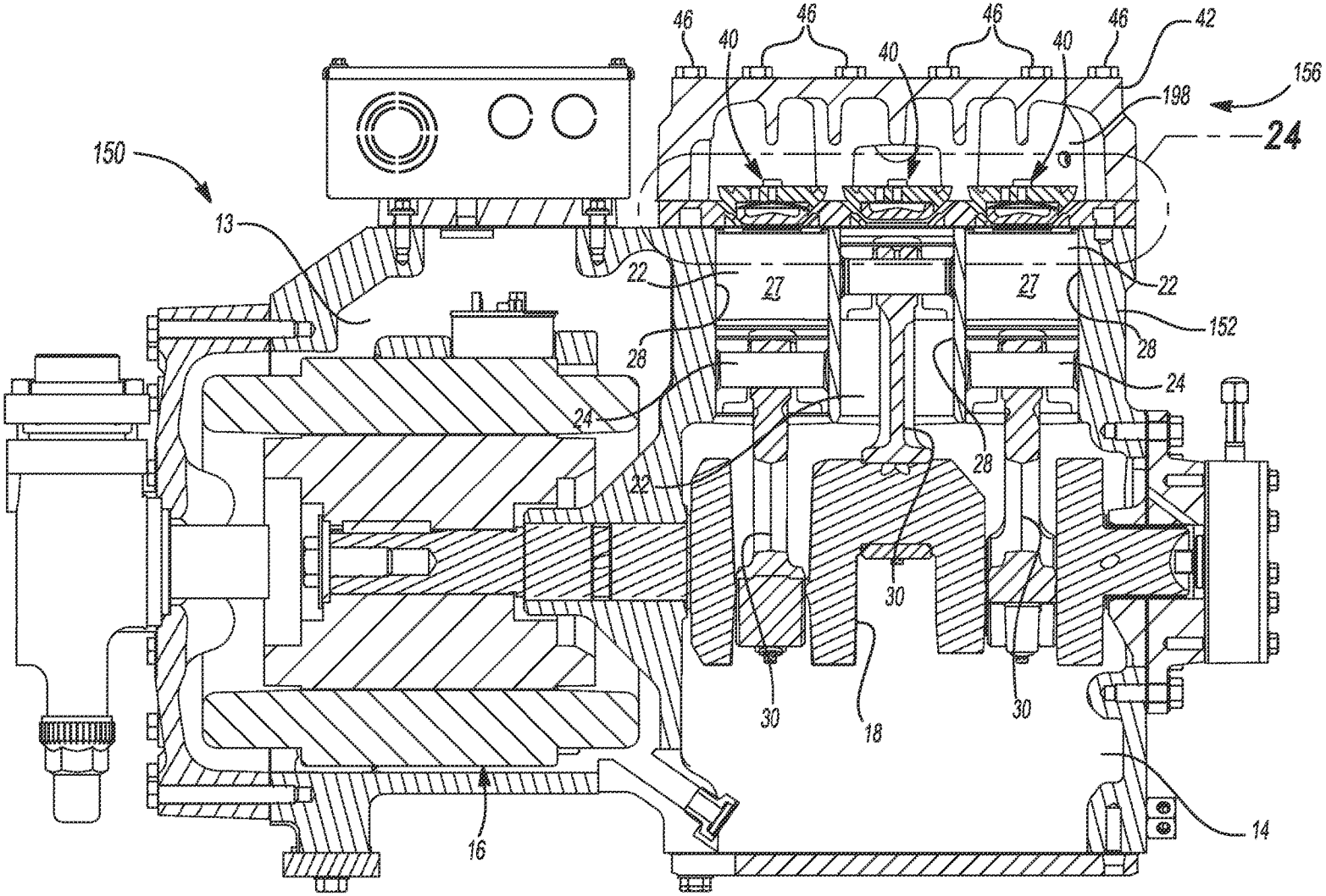
FIG. 23 is a cross-sectional view of the compressor assembly of FIG. 14 taken along a line 23-23 shown in FIG. 14.

As shown in FIGS. 15 and 23, the cylinder head 42 fits over the valve plate 158 and cooperates with the valve plate 158 to define a discharge chamber 198. The valve plate 158 forms the bottom wall of the discharge chamber 198, and the cylinder head 42 forms the sidewall and top wall of the discharge chamber 198. The third gasket 129 may be disposed between the cylinder head 42 and the valve plate 158 to provide a sealed relationship therebetween. The discharge chamber 198 receives discharge-pressure working fluid from the compression chambers 27 through the discharge valve 100 when the discharge valve 100 is in the open position. The discharge-pressure working fluid in the discharge chamber 198 may exit the compressor 10 through the compressor discharge valve 44.

To assemble the cylinder head assembly 156 to the housing 152, the fasteners 46 are inserted through the holes 130 in the cylinder head 42, through the holes 132 in the third gasket 129, through the holes 176 in the valve plate 158, through corresponding holes 199 in the fourth gasket 160, and into the counterbores 74 in the housing 152. Notably, the fasteners 46 do not extend through the suction valve retainer 174 when the cylinder head assembly 156 is assembled to the housing 152.

Operation of the compressor 150 is substantially similar to operation of the compressor 10, and therefore operation of the compressor 150 will only be briefly described. With reference to FIGS. 20-24, suction-pressure working fluid may be drawn into the suction chamber 161 from the suction plenum 13 via the suction passages 36 in the housing 152. During the suction stroke of one of the pistons 24 within a corresponding cylinder 22 (i.e., while the piston 24 is moving away from the cylinder head assembly 156), low fluid pressure within the compression chamber 27 will cause the suction valve 38 to move into the open position (i.e., where the lobes 92 contact the recesses 35).

Movement of the suction valve 38 into the open position allows the working fluid in the suction chamber 161 to flow into the compression chamber 27 through the suction port 188 as indicated by the arrows labeled 200 in FIG. 24. Because the outer diameter of the main body 90 of the suction valve 38 is less than the inner diameter of the cylinder 22 and because the main body 90 has the aperture 115, suction-pressure working fluid from the suction port 188 can flow around the outside of the main body 90 and through the aperture 115, thereby improving fluid flow into the compression chamber 27.

The low fluid pressure within the compression chamber 27 during the suction stroke of the piston 24 also causes the discharge valve 100 to move into the closed position (i.e., where the discharge valve 100 contacts the conical top surface 168 of valve plate 158 that forms the discharge valve seat), thereby restricting or preventing fluid flow between the compression chamber 27 and the discharge chamber 198. As described above, the discharge valves 100 move between the open and closed positions within the cylindrical pockets 122 defined in the discharge valve retainers 106.

After drawing suction-pressure working fluid into the compression chamber 27 during the suction stroke, the piston 24 moves back toward the cylinder head assembly 156 in a compression stroke. At the start of the compression stroke, increased fluid pressure within the compression chamber 27 (i.e., to a level higher than the fluid pressure within the suction chamber 161) forces the floating suction valve 38 upward toward the bottom surface 169 of the corresponding hollow conical frustum portion 164 and the bottom surface 182 of the suction valve retainer 174. As the suction valve 38 moves between its open and closed positions, the suction valve 38 is floating, i.e., the suction valve 38 is not retained by any solid structure above or below the suction valve 38. The higher fluid pressure within the compression chamber 27 during the compression stroke will retain the suction valve 38 in contact with the bottom surfaces 169 and 182 to restrict or prevent fluid flow between the compression chamber 27 and the suction chamber 161.

Increasing fluid pressure within the compression chamber 27 during the compression stroke of the piston 24 also causes the discharge valve 100 to move into the open position (i.e., where the discharge valve 100 is spaced apart from the conical top surface 168 of valve plate 158 that forms the corresponding discharge valve seat), thereby allowing compressed working fluid in the compression chamber 27 to flow through the discharge port 194 and into the discharge chamber 198 as indicated by the arrow labeled 202 in FIG. 24.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed above could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A valve plate assembly for a compressor assembly that includes a compressor housing defining multiple cylinders, the valve plate assembly comprising:

a valve plate configured to separate suction-pressure working fluid entering the cylinders of the compressor housing in a first direction from discharge-pressure working fluid exiting the cylinder of the compressor housing in a second direction, the valve plate defining a discharge valve seat and having a bottom surface configured to mount to the compressor housing; and a suction valve retainer configured to retain at least one suction valve within at least one suction valve seat disposed about a central longitudinal axis of one of the cylinders, wherein:

the at least one suction valve seat is defined by the compressor housing;

the suction valve retainer has a bottom surface configured to sealingly contact an outer perimeter of the at least one suction valve to limit movement of the at least one suction valve in the second direction when discharge-pressure working fluid is expelled from the cylinders of the compressor housing;

the bottom surface of the valve plate is coplanar with the bottom surface of the suction valve retainer;

the suction valve retainer includes interconnected annular disk portions that are each configured to be disposed about the central longitudinal axis of one the cylinders; and the valve plate and the suction valve retainer are integrally formed as a unitary body.

2. The valve plate assembly of claim 1, wherein the valve plate is configured to be attached to the compressor housing using fasteners, and the fasteners do not extend through the suction valve retainer when the valve plate assembly is assembled to the compressor housing.

3. The valve plate assembly of claim 1, wherein the valve plate includes a flat portion and hollow conical frustum portions projecting from the flat portion and configured to extend toward the cylinders when the valve plate is mounted to the compressor housing, each of the hollow conical frustum portions defining the discharge valve seat.

4. The valve plate assembly of claim 3, wherein the flat portion of the valve plate defines holes disposed about an outer perimeter of the flat portion for receiving fasteners to attach the valve plate to the compressor housing.

5. A valve plate assembly for a compressor assembly that includes a compressor housing defining multiple cylinders, the valve plate assembly comprising:

a valve plate configured to separate suction-pressure working fluid entering the cylinders of the compressor housing in a first direction from discharge-pressure working fluid exiting the cylinder of the compressor housing in a second direction, the valve plate defining a discharge valve seat; and a suction valve retainer configured to retain at least one suction valve within at least one suction valve seat disposed about a central longitudinal axis of one of the cylinders, wherein;

the at least one suction valve seat is defined by the compressor housing;

the suction valve retainer is configured to sealingly contact an outer perimeter of the at least one suction valve to limit movement of the at least one suction valve in the second direction when discharge-pressure working fluid is expelled from the cylinders of the compressor housing;

the suction valve retainer includes interconnected annular disk portions that are each configured to be disposed about the central longitudinal axis of one the cylinders;

the valve plate and the suction valve retainer are integrally formed as a unitary body;

the valve plate includes a flat portion and hollow conical frustum portions projecting from the flat portion and configured to extend toward the cylinders when the valve plate is mounted to the compressor housing, each of the hollow conical frustum portions defining the discharge valve seat;

the flat portion of the valve plate defines holes disposed about an outer perimeter of the flat portion for receiving fasteners to attach the valve plate to the compressor housing; and the valve plate further includes collars disposed about the holes and projecting from the flat portion of the valve plate, the collars being configured to locate the valve plate relative to the compressor housing in a plane parallel to a mounting surface of the compressor housing to which the valve plate is configured to be mounted.

6. The valve plate assembly of claim 1, wherein the valve plate is configured to be mounted to a mounting surface of the compressor housing, and the suction valve retainer is configured to be mounted to the same mounting surface of the compressor housing.

7. The valve plate assembly of claim 1, further comprising posts disposed between the valve plate and the suction valve retainer and configured to hold the suction valve retainer in place when discharge-pressure working fluid is expelled from the cylinders of the compressor housing, wherein the valve plate, the suction valve retainer, and the posts are integrally formed as a unitary body.

8. The valve plate assembly of claim 7, further comprising an annular projection disposed about an outer perimeter of the valve plate and configured to project from the valve plate toward a mounting surface of the compressor to which the valve plate is configured to be mounted, wherein the valve plate, the suction valve retainer, the posts, and the annular projection are integrally formed as a unitary body.

9. The valve plate assembly of claim 1, wherein the at least one suction valve has a first surface configured to face a piston within one of the cylinders and a second surface opposite of the first surface, and the second surface of the at least one suction valve is configured to engage the suction valve retainer.

10. The valve plate assembly of claim 1, wherein the at least one suction valve seat is recessed relative to a mounting surface of the compressor housing to which the valve plate is configured to be mounted.

11. The valve plate assembly of claim 1, wherein:

the at least one suction valve includes multiple suction valves; and the at least one suction valve seat includes multiple suction valve seats.

12. The valve plate assembly of claim 1, wherein the suction valve retainer is configured to extend radially outward from the central longitudinal axis of each of the cylinders without extending radially beyond a suction passage of the compressor housing.

13. A compressor assembly, comprising:

a compressor housing defining multiple cylinders, suction valve seats, and a mounting surface, wherein each of the suction valve seats is disposed about a central longitudinal axis of one of the cylinders;

a valve plate configured to mount to the mounting surface of the compressor housing and to separate suction-pressure working fluid entering the cylinders of the compressor housing in a first direction from discharge-pressure working fluid exiting the cylinders of the compressor housing in a second direction, the valve plate defining discharge valve seats and having a bottom surface configured to mount to the compressor housing; and a suction valve retainer configured to mount to the mounting surface of the compressor housing and to retain suction valves within the suction valve seats of the compressor housing, wherein:

the suction valve retainer has a bottom surface configured to sealingly contact outer perimeters of the suction valves to limit movement of the suction valves in the second direction when discharge-pressure working fluid is expelled from the cylinders of the compressor housing;

the bottom surface of the valve plate is coplanar with the bottom surface of the suction valve retainer;

the suction valve retainer includes interconnected annular disk portions that are each configured to be disposed about the central longitudinal axis of one the cylinders; and the valve plate and the suction valve retainer are integrally formed as a unitary body.

14. The compressor assembly of claim 13, wherein the suction valve seats are recessed relative to the mounting surface.

15. The compressor assembly of claim 13, further comprising posts disposed between the valve plate and the suction valve retainer and configured to hold the suction valve retainer in place when discharge-pressure working fluid is expelled from the cylinders of the compressor housing, wherein the valve plate, the suction valve retainer, and the posts are integrally formed as a unitary body.

16. The compressor assembly of claim 13, wherein the valve plate includes a flat portion and hollow conical frustum portions projecting from the flat portion and configured to extend toward the cylinders when the valve plate is mounted to the compressor housing, the hollow conical frustum portions defining the discharge valve seats.

17. The compressor assembly of claim 16, wherein each of the hollow conical frustum portions of the valve plate is concentric with a corresponding one of the annular disk portions of the suction valve retainer.

18. The compressor assembly of claim 13, wherein each of the suction valves has a first surface configured to face a piston within one of the cylinders and a second surface opposite of the first surface, and the second surface of each of the suction valves is configured to engage the suction valve retainer.

19. The compressor assembly of claim 13, wherein the suction valve retainer is configured to extend radially outward from the central longitudinal axis of each of the cylinders without extending radially beyond a suction passage of the compressor housing.

* * * * *